US005795695A

United States Patent [19]

Malhotra et al.

[11] Patent Number: 5,795,695

[45] Date of Patent: Aug. 18, 1998

[54] RECORDING AND BACKING SHEETS CONTAINING LINEAR AND CROSS-LINKED POLYESTER RESINS

[75] Inventors: Shadi L. Malhotra, Mississauga; T. Brian Mcaneney; James H. Sharp, both of Burlington; Kirit N. Naik, Mississauga, all of Canada

[73] Assignee: Xerox Corporation, Stamford, Conn.

[21] Appl. No.: 720,524

[22] Filed: Sep. 30, 1996

[51] Int. Cl.[6] ..... G03G 15/22

[52] U.S. Cl. ..... 430/120; 430/47; 430/97; 430/124; 430/126; 156/230; 156/239

[58] Field of Search ..... 430/47, 97, 120, 430/124, 126; 156/230, 239

[56] References Cited

U.S. PATENT DOCUMENTS

| | | | |
|---|---|---|---|
| 3,488,189 | 1/1970 | Mayer et al. | 96/1.5 |
| 3,561,337 | 2/1971 | Mulkey | 95/1 |
| 3,914,097 | 10/1975 | Wurl | 432/59 |
| 4,066,802 | 1/1978 | Clemens | 427/24 |
| 4,526,847 | 7/1985 | Walker et al. | 430/18 |
| 4,600,669 | 7/1986 | Ng et al. | 430/47 |
| 4,686,163 | 8/1987 | Ng et al. | 430/47 |
| 4,724,026 | 2/1988 | Nelson | 156/233 |
| 4,868,049 | 9/1989 | Nelson | 428/328 |
| 4,956,225 | 9/1990 | Malhotra | 428/216 |
| 5,006,407 | 4/1991 | Malhotra | 428/336 |
| 5,065,183 | 11/1991 | Morofuji et al. | 355/202 |
| 5,108,865 | 4/1992 | Zwaldo et al. | 430/126 |
| 5,118,570 | 6/1992 | Malhotra | 428/474.4 |
| 5,126,797 | 6/1992 | Forest | 355/278 |
| 5,302,439 | 4/1994 | Malhotra et al. | 428/195 |
| 5,314,747 | 5/1994 | Malhotra et al. | 428/341 |
| 5,320,902 | 6/1994 | Malhotra et al. | 428/342 |
| 5,327,201 | 7/1994 | Coleman et al. | 355/278 |
| 5,330,823 | 7/1994 | Malhotra | 428/195 |
| 5,337,132 | 8/1994 | Cherian | 355/278 |
| 5,342,685 | 8/1994 | Gobran | 428/355 |
| 5,346,766 | 9/1994 | Otter et al. | 428/355 |
| 5,352,530 | 10/1994 | Tanuma et al. | 428/442 |
| 5,378,536 | 1/1995 | Miller et al. | 428/355 |
| 5,413,840 | 5/1995 | Mizuno | 428/195 |
| 5,418,208 | 5/1995 | Takeda et al. | 503/227 |
| 5,441,795 | 8/1995 | Malhotra et al. | 428/195 |
| 5,457,486 | 10/1995 | Malhotra et al. | 347/105 |
| 5,665,505 | 9/1997 | Malhotra | 430/97 |

*Primary Examiner*—Mark Chapman

[57] ABSTRACT

Disclosed is a method of creating simulated, photographic-quality prints using transparent polyester substrates such as Mylar®; polypropylene, and the like. Reverse or wrong reading images are formed on the substrate using a linear or crosslinked low melt polyester toner and mixtures thereof. The reverse or wrong reading images are permanently adhered to the polyester substrate followed by the application of a backing member to the imaged transparent substrate. The backing member is characterized by being opaque and being coated with linear or crosslinked low melt polyester resin system to generate high fidelity, grain free photographic-quality images with reduced curl and improved adhesion due to similar rheological responses of the compatible materials in the toner, imaging substrate and the backing substrate.

34 Claims, 2 Drawing Sheets

RECORDING AND BACKING SHEETS CONTAINING LINEAR AND CROSS-LINKED POLYESTER RESINS

BACKGROUND OF THE INVENTION

The present invention is directed to creating simulated photographic-quality images or prints using non-photographic imaging such as xerography and/or ink jet printing and/or copying. More specifically, the present invention is directed to creating simulated, photographic-quality prints using polyester materials for the image creation image substrates and coatings for the substrates resulting in prints without grainy appearance, and which exhibit reduced curl due to similar rheological responses of the polyester materials.

The present invention is directed to creating simulated, photographic-quality images of reduced curl and free of grainy appearances, comprising (a) scanning a wrong reading/reverse electrostatic image on an imaging member in an imaging apparatus, developing the latent image with a polyester toner and transferring the developed image to a transparent polyester imaging substrate also coated with a polyester resin; (b) laminating the imaged transparent substrate with heat and pressure to an opaque backing substrate coated with a first layer in contact with the backing substrate comprised of a polyester resin, and a second layer on top of the first layer comprised of a toner wetting agent selected from the group consisting of polyglycol esters. The laminate generates photographic-quality prints without grainy appearance, and exhibits reduced curl due to similar rheological responses of the materials in the toner, imaging substrate and the backing substrate. More specifically the present invention is directed to creating simulated, photographic-quality images with reduced curl, improved adhesion and free of grainy appearances, comprising (a) scanning a wrong reading/reverse electrostatic image on an imaging member in an imaging apparatus, developing the latent image with a polyester toner and transferring the developed image to a transparent polyester imaging substrate coated with polyester resin; (b) laminating the imaged substrate with heat and pressure to a backing substrate coated with a first layer in contact with the backing substrate comprised of a polyester resin, and an adhesion promoting ester compound and a second layer on top of the first layer comprised of a toner wetting agent selected from the group consisting of polyglycol esters. The laminate generates photographic-quality images without grainy appearance, with reduced curl and improved adhesion due to improved rheological responses of the materials in the toner, imaging substrate and the backing substrate.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic and/or ink jet imaging process. Such efforts have resulted in the introduction of the Xerox 5775™ copier/printer, the Xerox 4900™ and the Fuji Xerox A-Color 635™ machine into the market place.

Notwithstanding all the recent development in the area of color printers and copiers there is room for improvement in the quality of color images on paper and synthetic substrates such as Mylar® and Teslin®. The foregoing is particularly true when trying to create photographic-quality images using non photographic processes.

Attempts at improving conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print.

Additionally, it is believed that the aforementioned lamination process doesn't produce good results because typically the color toner images at the interface between the laminate and the toner do not make suitable optical contact. That is to say, the initially irregular toner image at the interface is still irregular (i.e. contains voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

A known method of improving the appearance of color xerographic images on a transparent substrate comprises refusing the color images. Such a process was observed at a NOMDA trade show in 1985 at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. The refuser was also used during the exhibit for refusing color images on paper. However, the gloss is image-dependent. Thus, the gloss is high in areas of high toner density because the toner refuses in contact with the clear plastic sheet and becomes very smooth. In areas where there is little or no toner the gloss is only that of the substrate. The refuser was also used during the exhibit for refusing color images on paper.

Following is a discussion of additional prior art which may bear on the patentability of the present invention. In addition to possibly having some relevance to the question of patentability, these references, together with the detailed description to follow, should provide a better understanding and appreciation of the present invention. The prior art discussed herein as well as the prior art cited therein is incorporated herein by reference.

Copending application U.S. Ser. No. 08/583,913 filed on Jan. 11, 1996), with the named inventor Shadi L. Malhotra, discloses that coated sheets or substrates such as paper, opaque Mylar®, Teslin® or the like are utilized in the creation of simulated, photographic-quality prints formed using non photographic imaging procedures such as xerography and ink jet. A first substrate has a reverse reading image formed thereon. Such an image may be formed using conventional color xerography. A second substrate having a right reading image containing the same information as the first substrate is adhered to the first substrate. The foregoing results in a simulated photographic-quality print which has a relatively high optical density compared to prints using only the reverse reading image on the one substrate. This application including all of the references cited therein are incorporated herein by reference.

U.S. Pat. Nos. 5,327,201 and 5,337,132 granted to Robert E. Coleman on Jul. 5, 1994 and to Abraham on Aug. 9, 1994, respectively, disclose the creation of simulated photographic prints using xerography. To this end, reverse reading images are formed on a transparent substrate and backing substrate is adhered to the transparent substrate. U.S. patent applications Ser. Nos. 08/095,639, 08/095,622, 08/095,016, 08/095,136 and 08/095,639 cited in the '132 patent are also incorporated herein by reference.

Protective sheets used in various printing and imaging processes are well known. For example, U.S. Pat. No. 5,418,208 (Takeda and Kawashima) discloses a laminated plastic card providing a lamination of a dye accepting layer, a substrate of paper or the like, and a back coat layer on which lamination one or more patterns are printed with a volatile dye, and a transparent plastic film adhered on the lamination by an adhesive agent, wherein the adhesive agent is a saturated polyester having an average molecular weight of 18,000 gm/mole and produced by condensation polymerization of polypropylene glycol or trimethylol propane and adipic acid or azelaic acid.

U.S. Pat. No. 5,413,840 (Mizuno) discloses a decorative laminated sheet having a sense of being coated and having improved surface hardness, which is produced by laminating a polyester film excellent in transparency on the surface of a semi-rigid thermoplastic resin film supplied with a colored layer or a pattern-printed layer, and then coating a hard coat layer comprising a UV-curable coating on the surface of the polyester film of the resulting laminated film, and a process for producing the same. This invention can provide a sheet not only excellent in scratch resistance, specular reflectivity and sharpness of the surface, but having a sense of being deeply coated as well.

U.S. Pat. No. 5,378,536 (Miller and Clements) discloses a repositionable adhesive tape where an adhesive of certain elastomeric block copolymers and tackifying materials can be hot-melt coated on to a flexible backing to provide an adhesive tape, two pieces of which can bond to each other to have excellent resistance to shear forces but can be easily peeled apart, even after prolonged periods of time. The adhesive can be low-tack or tack-free. When the novel adhesive is tacky, it can bind sheets into a note pad from which individual sheets can be removed, temporarily adhered to paper and other substrates, and later cleanly removed, even after prolonged contact.

U.S. Pat. No. 5,352,530 (Tanuma et al) discloses a highly transparent film having high strength, suitable extensibility, high weather resistance, low moisture consists mainly of ethylene-vinylacetate copolymer. Various laminates making the most of the above properties of the film are disclosed, which comprise the ethylene-vinylacetate copolymer interposed between two inorganic material sheets, two organic material sheets, or an inorganic material sheet and an organic material sheet.

U.S. Pat. No. 5,346,766 (Otter and Watts) discloses a positionable-repositionable pressure sensitive adhesive that may be repeatedly applied to a surface and removed during an initial installation time period. The adhesive contains an adhesive base resin and coacting detackifying resin and particulate components which temporarily reduce the tack and peel strength of the adhesive. Upon passage of time and/or application of thermal energy, adhesion build-up occurs to a maximum value. The pressure-sensitive adhesive may be used as an adhesive layer in a laminate for tapes, signs and decorative and protective applications including vehicle marking and architectural installations.

U.S. Pat. No. 5,342,685 (Gobran) discloses a hot melt coatable pressure-sensitive adhesive showing high levels of adhesion to low surface energy films and nonwovens. The adhesive elastomeric phase comprises from 78 to 98 parts by weight of a diblock A-B type block copolymer with an elastomeric block of 1,3-polybutadiene with 2 to 22 parts by weight of multiblock A-B type block copolymer. The tackifying material comprises 140 parts or less of a solid tackifying resin and a liquid tackifier to provide an adhesive having a composite midblock glass transition of −10° C.

U.S. Pat. No. 5,118,570 (Malhotra) and U.S. Pat. No. 5,006,407 (Malhotra), the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 4,526,847 (Walker et al.) discloses a transparency for the formation of an adherent electrostatic image thereon which includes a polyester resin film sheet having an image-receiving coating of nitrocellulose, a plasticizer, a particulate material, and, preferably, an antistatic agent. The coating is applied to the film sheet from a solvent mixture of an aliphatic ester or an aliphatic ketone, and an aliphatic alcohol.

U.S. Pat. No. 3,561,337 (Mulkey) discloses a sheet material having a transparent backing coated with a layer containing a polymeric binder and particles of solid material which is insoluble in the binder. The refractive index of the solid material varies from that of the binder by at most ±0.6. The surface of the layer is ink receptive and, by printing on that surface, a transparency is obtained.

U.S. Pat. No. 3,488,189 (Mayer et al.) discloses the formation of fused toner images on an imaging surface corresponding to an electrostatic field by depositing on the imaging surface in image configuration toner particles containing a thermoplastic resin, the imaging surface carrying a solid crystalline plasticizer having a lower melting point than the melting range of the thermoplastic resin and heat fusing the resulting toner image.

U.S. Pat. No. 4,956,225 (Malhotra) discloses a transparency suitable for electrographic and xerographic imaging which comprises a polymeric substrate with a toner receptive coating on one surface. Also disclosed are transparencies with first and second coating layers.

U.S. Pat. No. 5,302,439 (Malhotra and Bryant) discloses a recording sheet which comprises (a) a substrate; (b) a coating on the substrate which comprises a binder and a material having a melting point of less than about 65° C. and a boiling point of greater than 150° C. and selected from the group consisting of alkyl phenones, alkyl ketones, halogenated alkanes, alkyl amines, alkyl anilines, alkyl diamines, alkyl alcohols, alkyl diols, halogenated alkyl alcohols, alkane alkyl esters, saturated fatty acids, unsaturated fatty acids, alkyl aldehydes, alkyl anhydrides, alkanes, and mixtures thereof; (c) an optional traction agent; and (d) an optional antistatic agent.

Copending application U.S. Ser. No. 08/034,917 with the named inventors Shadi L. Malhotra, Brent S. Bryant, and Doris K. Weiss, filed Mar. 19, 1993, entitled "Recording Sheets Containing Phosphonium Compounds" discloses a recording sheet which comprises a base sheet, a phosphonium compound, an optional pigment, and an optional binder.

U.S. Pat. No. 5,314,747 (Malhotra & Bryant) entitled "Recording Sheets Containing Cationic Sulfur Compounds" discloses a recording sheet which comprises (a) a base sheet; (b) a cationic sulfur compound selected from the group consisting of sulfonium compounds, thiazolium compounds, benzothiazolium compounds, and mixtures thereof; (c) an optional binder; and (d) an optional pigment.

U.S. Pat. No. 5,441,795 (Malhotra & Bryant) discloses a recording sheet which comprises a base sheet and a material selected from the group consisting of pyridinium compounds, piperazinium compounds, and mixtures thereof.

U.S. Pat. No. 5,320,902 (Malhotra et al) entitled "Recording Sheets Containing Monoammonium Compounds" discloses a recording sheet which consists essentially of a substrate and, in contact with the substrate, a monoammonium compound.

U.S. Pat. No. 5,457,486 (Malhotra et al) entitled "Recording Sheets Containing Tetrazolium, Indolinium, and Imidazolinium Compounds" discloses a recording sheet which comprises (a) a base sheet; (b) a material selected from the group consisting of tetrazolium compounds, indolinium compounds, imidazolinium compounds, and mixtures thereof; (c) an optional pigment; and (d) an optional binder.

Copending application U.S. Ser. No. 08/208,317 with the named inventor Shadi L. Malhotra, entitled Recording Sheets for Ink Jet Printing Processes discloses a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; and (b) causing droplets of the ink to be ejected in an imagewise pattern onto a surface of the recording sheet containing microspheres, thereby generating images on the recording sheet. Also disclosed is a printing process which comprises (a) incorporating into an ink jet printing apparatus containing an aqueous ink a recording sheet which comprises (1) a substrate; (2) a first coating layer which comprises a binder and microspheres; (3) a second, ink-receiving coating layer situated so that the first coating layer is between the second, ink-receiving coating layer and the substrate, said second, ink-receiving layer comprising a hydrophilic binder and microspheres; (4) an optional antistatic agent; (5) an optional biocide; and (6) an optional filler; (b) causing droplets of the ink to be ejected in an imagewise pattern onto a surface of the recording sheet containing microspheres, thereby generating images on the recording sheet; and (c) thereafter exposing the substrate to microwave radiation, thereby drying the recording liquid on the recording sheet.

Copending application U.S. Ser. No. 08/196,679 with the named inventor Shadi L. Malhotra, entitled "Recording Sheets Containing Amino Acids, Hydroxy Acids, and Polycarboxyl Compounds" discloses a recording sheet which comprises a paper substrate and a material selected from the group consisting of monomeric amino acids, monomeric hydroxy acids, monomeric polycarboxyl compounds, and mixtures thereof. Another embodiment is directed to a recording sheet which comprises a substrate and an additive material selected from the group consisting of monomeric amino acids, monomeric hydroxy acids, and mixtures thereof.

Copending application U.S. Ser. No. 08/196,607, with the named inventor Shadi L. Malhotra, entitled "Recording Sheets Containing Amine Salts and Quaternary Choline Halides" discloses a recording sheet which comprises a substrate and a material selected from the group consisting of monomeric amine acid salts, monomeric quaternary choline halides, and mixtures thereof.

Copending application U.S. Ser. No. 08/196,605 with the named inventors Shadi L. Malhotra, Brent S. Bryant, and Arthur Y. Jones, entitled "Recording Sheets Containing Mildew Preventing Agents" discloses a recording sheet which comprises a substrate, an image receiving coating, and a biocide.

U.S. Pat. Nos. 4,686,163 and 4,600,669 describe an electrophotographic imaging method that uses an element comprising a photoconductive layer on an electrically conducting substrate capable of transmitting actinic radiation to which the photoconductive layer is responsive, and a dielectric support, releasably adhered to the substrate, comprising the photoconductive layer or an overcoat thereof forming a surface of the element capable of holding an applied electrostatic charge. To use the element, the surface of the dielectric support is charged, and the photoconductive layer is imagewise-exposed to actinic radiation, thereby forming a developable electrostatic image on the dielectric surface. The electrostatic image, in turn, is developed with toner to form a first color image. A composite color image is formed on the element by repeating the sequence one or more times with imagewise exposure of the photoconductive layer to actinic radiation transmitted through the substrate, and developing over each preceding image with a different color toner. The composite tone image is transferred with the dielectric support to a receiving element to form a color copy such as a three-color filter array or a color proof closely simulating the color print expected from a full press run.

The dielectric support on the photoconductive layer comprised a transparent blend of (vinylacetate-co-crotonic acid, 95/5 mole ratio) and cellulose acetate butyrate. The resulting multicolor proof presented a multicolor toner image against a white paper background and protected by the overlying dielectric support, thus accurately resembling a multicolor print from a full press run.

The receiver element to which the dielectric support and composite toner image are transferred can be any suitable material against or through which the toner image is desired to be viewed. The receiver can be print stock, such as paper, upon which a press run will be conducted. The receiver can also be of transparent material such as a polymeric film.

With respect to the latter, the invention also contemplates, as an embodiment, transfer of the composite toner image and dielectric support to image-bearing elements such as microfilm or microfiche so that the composite color image forms information in addition to image information already present on such image-bearing elements. In addition, the invention contemplates the use of transparent glass or non birefringent translucent polymeric materials such as cellulose esters for use as the receiver. Receivers manufactured from such materials are suited for use informing three-color filter arrays by the process described herein involving the formation of filter array matrices of the complementary colorants cyan, magenta and yellow in the respective color toner imaging steps. If desirable, the receiver can also contain a suitable overcoat layer adapted to soften under the influence of pressure and heat during the transfer step. In this manner, the adhesion of the dielectric support and composite toner image to the receiver can be enhanced.

The electrophotographic element bearing the multicolor toner image is moved to a separate lamination device comprising heated metal and rubber rolls, together forming a nip. The toner image is passed through the nip with and against a white receiver paper at a roll temperature of 100° C. (212° F.) and a pressure of 225 pounds per square inch to effect transfer of the dielectric support and composite image to the receiver followed by peeling off the rest of the electrophotographic element.

U.S. Pat. No. 4,066,802 granted on Jan. 3, 1978 to Carl F. Clemens discloses a method of decalcomania in which a toner image pattern is formed on a transfer member which has been overcoated with an abhesive material. A polymeric sheet is interposed between the toner image and a cloth or other image receiving medium. The polymeric sheet assists in the permanent adherence of the toner imaging pattern to the cloth material or other medium when the composite is subjected to heat and pressure. The transfer member and method of its use are set forth. Another embodiment discloses the use of a solvent to fix the image to a cloth material.

U.S. Pat. No. 5,065,183 granted on Nov. 12, 1991 to Morofuji et al discloses a multicolor printing method for printing multicolor picture images upon a material or object to be printed comprises the steps of, in accordance with a first embodiment of the invention, the formation of a multicolor toner image upon a flexible belt by means of electrophotographic printing methods or techniques, and the transfer of such multicolor toner image directly to the material or object to be printed, such as, for example, a container made of, for example, metal, paper, plastic, glass, or the like, by means of a thermo-transferring process. In accordance with a second embodiment of the invention, the multicolor toner image is formed upon a plastic film, which is laminated upon the flexible belt, by means of electrophotographic printing methods or techniques, and the plastic film is then transferred to and fused upon the container. In accordance with a third embodiment of the invention, a photoconductive member is irradiated by means of exposure light upon a rear surface thereof wherein the multicolor picture images are also formed by electrophotographic printing methods or techniques. In this manner, previously formed toner images upon the photoconductive member do not interfere with the image exposure processing.

U.S. Pat. No. 5,126,797 granted on Jun. 30, 1992 to Forest et al discloses a method and apparatus for laminating toner images wherein a toner image on a receiving sheet is laminated using a transparent laminating sheet fed from the normal copy sheet supply of a copier, printer or the like. The laminating sheet is fed into laminating contact with the toner image after the toner image has been formed on a receiving sheet. The resulting sandwich is fed through the fuser laminating the image between the sheets. The invention is particularly usable in forming color transparencies.

U.S. Pat. No. 5,108,865 granted to Zwaldo et al on Apr. 28, 1992 discloses a method including the steps of: contacting an image (preferably multi-toned image) with a transfer web (intermediate receptor layer) comprising in sequence, a carrier layer, a transferable release layer, and a releasable adhesive layer (releasable from the carrier layer along with the transferable release layer so that both layers transfer at once), said adhesive layer being in contact with said toned image, said contacting being done under sufficient heat and/or pressure to enable said toned image to be adhered to said releasable adhesive layer with greater strength than the adherence of said toned image to said imaging surface of said photoconductive layer; separating the transfer web and said photoconductive layer so that the toned image is removed from said photoconductive layer and remains adhered to the adhesive layer of the transfer web; contacting the surface of the transfer web having both the multi-toned image and adhesive thereon with a permanent receptor removing the carrier layer of the transfer web from the adhesive and the release layer of the transfer web so that an image article is formed of the permanent receptor, multi-toned image, releasable adhesive, and the resultant surface coating of the release layer which is furthest away from the permanent receptor.

U.S. Pat. Nos. 4,868,049 and 4,724,026 granted to Marshall A. Nelson on Feb. 9, 1988 and Sep. 19, 1989, respectively disclose selective metallic transfer foils for selectively transferring metallic foil to xerographic images on are receiving substrate such as paper. The transfer sheet comprises, in successive layers, a carrier film, a metallic film and an adhesive, the adhesive containing a dispersion of 0.5 micron or larger particulate material. A method is disclosed for forming images overlaid with metallic foil. According to the method of the invention, a sheet comprising xerographic images is provided and placed in face-to-face contact with a metal transfer sheet, to form a sandwich with the xerographic images on the inside. Heat and pressure are applied to the sandwich, causing the xerographic images to become tacky and causing the metallic foil to selectively adhere to the images. The remainder of the transfer sheet is then stripped away from the resulting decorated sheet comprising xerographic images overlaid with metallic foil.

U.S. Pat. No. 3,914,097 granted to Donald R. Wurl on Oct. 21, 1975 discloses a sheet guide and cooling apparatus for preventing curl in sheets bearing a developed image, the image being permanently fixed to the sheet by application of heat and pressure. The apparatus is positioned to have a flat thermally conductive surface establishing a path for the sheet, downstream of the fixing area, the path extending in a plane substantially coplanar with the plane of sheet travel in the fixing station. Vacuum means associated with the surface maintains successive incremental portions of a sheet in face-to-face contact with the flat surface as it is being guided for at least a predetermined period as the sheet moves along the path and provides a flow of cooling air for the surface.

U.S. Pat. No. 5,330,823 granted on Jul. 19, 1994 to Shadi L. Malhotra discloses a substantially transparent recording sheet which comprises (a) a substantially transparent substrate; (b) a binder polymer coated on the substrate; and (c) particles of an antistatic component which are present on at least the surface of the binder polymer coating.

U.S. patent application Ser. No. 07/828,821 filed on Sep. 31, 1992 discloses a method and apparatus for enhancing color fidelity in a printing process employing an intermediate member wherein a developing unit deposits a colorless and transparent material directly onto an intermediate member before transfer of any color toner images thereto. Alternatively, a developing unit first deposits the colorless and transparent material on a latent image member. The colorless and transparent material is then transferred to the intermediate member before transfer of any color toner images thereto.

BRIEF SUMMARY OF THE INVENTION

The invention is directed to creating simulated photographic-quality color images of reduced curl, increased adhesion and improved image and color fidelity comprising (a) scanning a wrong reading/reverse electrostatic image on an imaging member in an imaging apparatus, developing the latent image with a linear or crosslinked low melt polyester toner and mixtures thereof and transferring the developed image to a imaging substrate coated with linear or crosslinked low melt polyester resin system; (b) laminating the imaged substrate with heat and pressure to a backing substrate coated with linear or crosslinked low melt polyester resin system to generate high fidelity grain free photographic quality images with reduced curl and improved adhesion due to similar rheological responses of the compatible materials in the toner, imaging substrate and the backing substrate.

In another embodiment of the invention, the degree of polyester crosslinking in the composition of the toner may be different to that of the coating material selected for the transparent imaging substrate which in turn may be different than that used for the coatings on the backing substrate. For example in one specific case the toner may contain a polyester that is 12 percent crosslinked, whereas 6 percent crosslinked polyester may be used for the coatings on the transparent imaging substrate and 0–3 percent crosslinked polyester may be used for the coatings on the backing substrate. In order to further minimize the chemical and surface variables of the print or laminate, it is preferred to use polyester, i.e. Mylar®, as the base material for the transparent imaging substrate and filled polyester, i.e., opaque Mylar®, as the base material for the backing substrate of the present invention.

Other features of the present invention will become apparent as the following description proceeds and upon reference to the drawings, in which:

PREFERRED EMBODIMENT OF THE INVENTION

Figure 1:
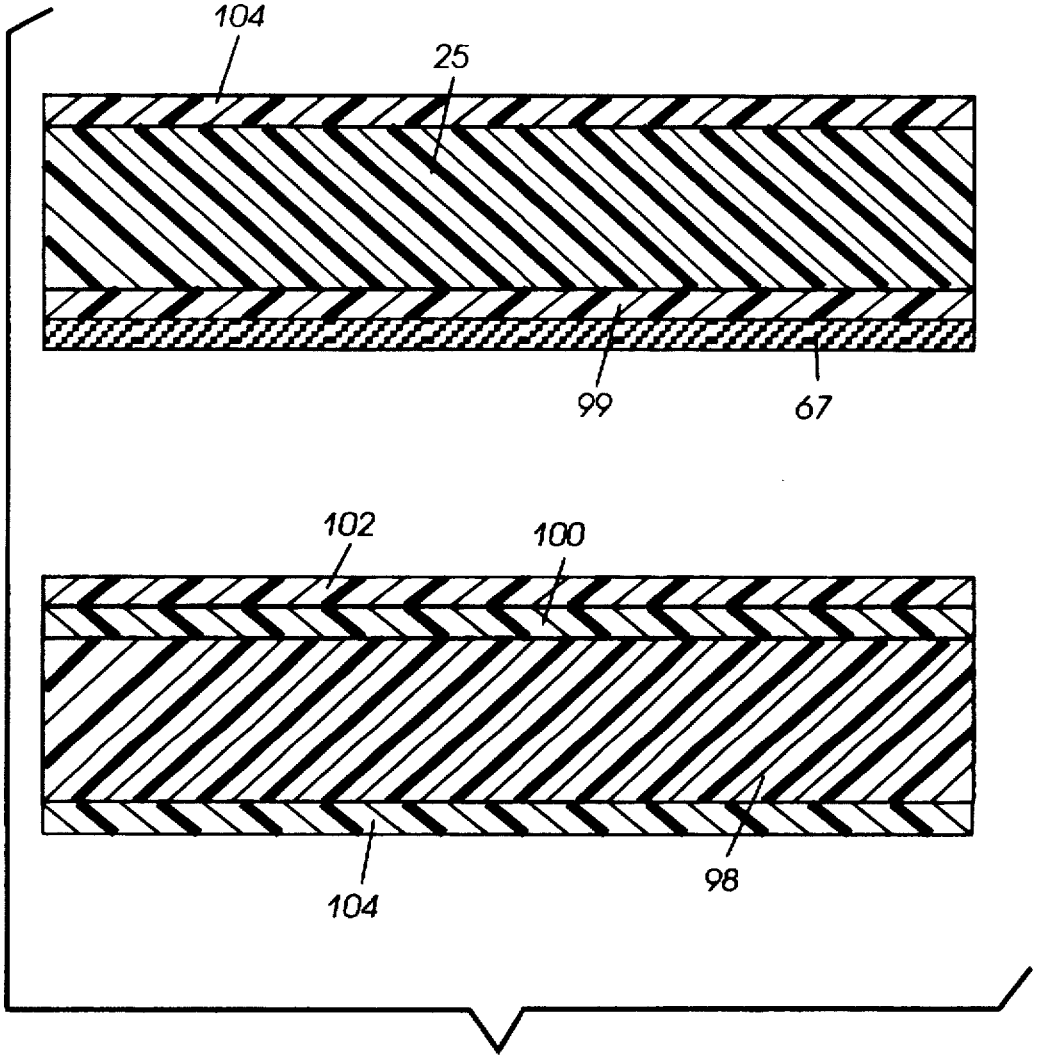
FIG. 1 is a view of a pair of substrates utilized for creating simulated photographic-quality prints using a non-photographic imaging process.
Figure 2:
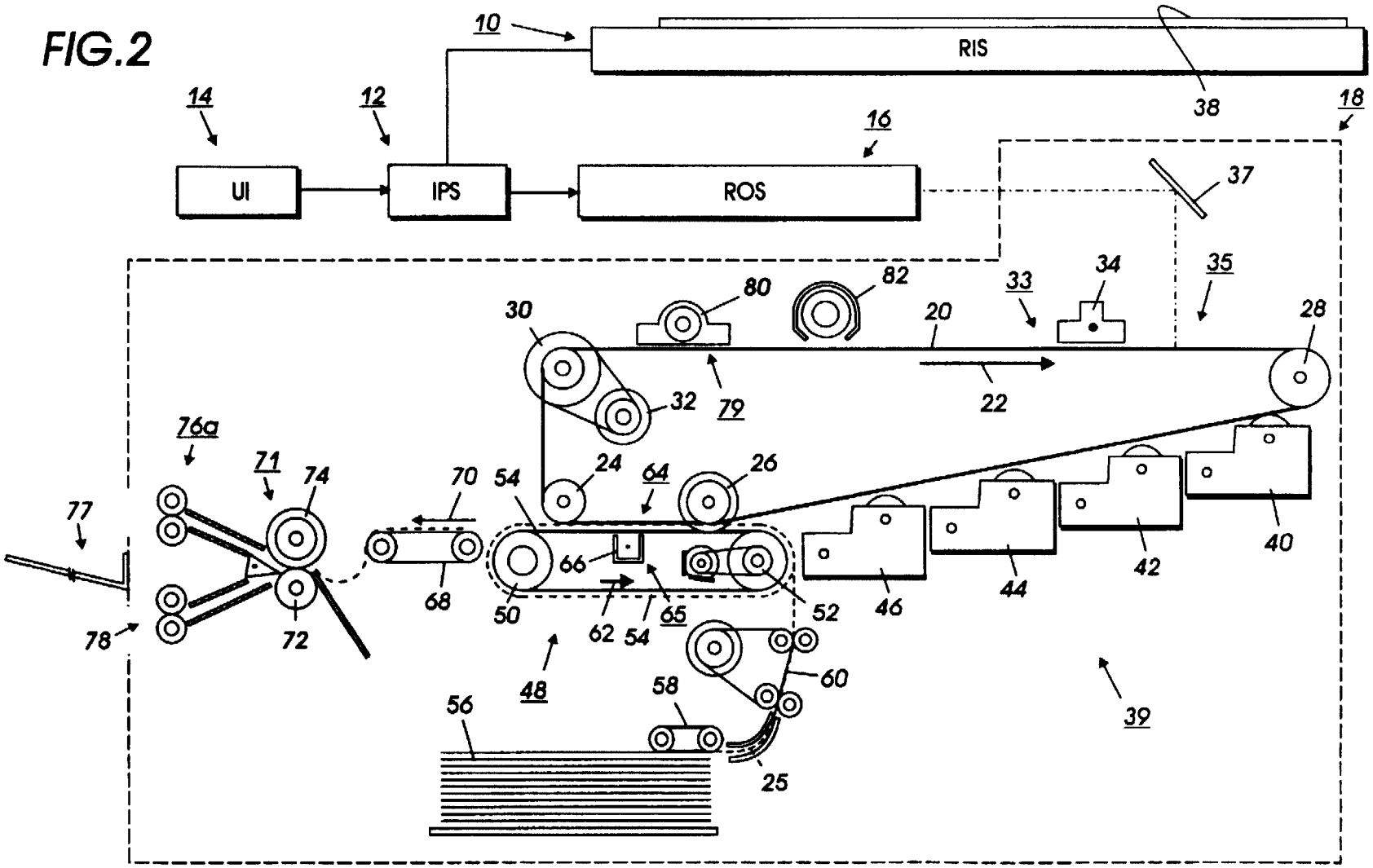
FIG. 2 is a schematic elevational view of an illustrative electrophotographic imaging apparatus which may be utilized in carrying out the present invention.

For a general understanding of the features of the present invention, reference is made to the drawings FIG. 1 and FIG. 2. In the drawings, like reference numerals have been used throughout to identify identical elements.

While the present invention will hereinafter be described in connection with least one preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing systems, and is not necessarily limited in its application to the particular system shown herein.

Turning initially to FIG. 2, during operation of a printing system 9, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon. The printing system 9 is capable of printing conventional right reading toner images on plain paper or mirror images on various other kinds of substrates utilized in the commercially available 5775™ copier.

With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of calorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with a rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

According to the present invention, the document 38 preferably comprises a black and white or color photographic print. It will be appreciated that various other documents may be employed without departing from the scope and true spirit of the invention.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 2, developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image.

Referring again to FIG. 2 one skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multi-color facsimile of the colored original document. As may be appreciated, the imaging process is not limited to the creation of color images. Thus, high optical density black and white simulated photographic-quality prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an outlet opening 78 through which substrate 25 is conveyed. Alternatively, the substrates can be advanced by a pair of rollers **76*a* to a catch tray 77**.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

A process and apparatus for forming simulated photographic-quality prints which use the transparency 25 containing the composite, reverse reading color image and a coated backing substrate 98 are disclosed in U.S. Pat. No. 5,337,132 granted to Abraham Cherian on Aug. 9, 1994. Alternatively, simulated photographic-quality prints may be created using the apparatus and method described in U.S. Pat. No. 5,327,201 granted to Coleman et al on Jul. 5, 1994.

Examples of substantially transparent and opaque substrate materials include polyesters, including Mylar®, available from E.I. Du Pont de Nemours & Company, Melinex®, available from Imperial Chemicals, Inc., Celanar®, available from Celanese Corporation, polyethylene naphthalates, such as Kaladex®PEN Films, available from Imperial Chemicals, Inc., polycarbonates such as Lexan®, available from General Electric Company, polysulfones, such as those available from Union Carbide Corporation, polyether sulfones, such as those prepared from 4,4'-diphenyl ether, such as Udel®, available from Union Carbide Corporation, those prepared from disulfonyl chloride, such as Victrex®, available from ICI Americas Incorporated, those prepared from biphenylene, such as Astrel®, available from 3M Company, poly(arylene sulfones), such as those prepared from crosslinked poly(arylene ether ketone sulfones), cellulose triacetate, polyvinylchloride cellophane, polyvinyl fluoride, polyimides, and the like, with polyester such as Mylar® being preferred in view of its availability and relatively low cost. The substrate can also be opaque, including opaque plastics, such as Teslin®, available from PPG Industries, and filled polymers, such as filled Melinex®, available from ICI. Filled plastics can also be employed as the substrate, particularly when it is desired to make a "never-tear paper". Other examples of materials for use as an opaque backing substrate include, commercially available internally and externally (surface) sized papers such as Diazo papers, offset papers such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto, Sanyo, and coated base papers available from companies such as Scholler Technical Papers, Inc. and the like.

The substrates can be of any effective thickness. Typical thicknesses for the substrate are from about 50 to about 500 microns, and preferably from about 100 to about 125 microns, although the thickness can be outside these ranges.

Each of the substrates 25 and 98 may be provided with one or more coatings for producing enhanced simulated color photographic-quality prints using non photographic imaging processes such as xerography. Each substrate is preferably coated on one side with at least one coating.

The transparent substrate 25 is preferably coated on one side or surface with a polyester binder polymer coating 99 (FIG. 1) used as toner receiving layer. Typically in this toner receiving layer, the binder or mixture thereof is present in amounts of from about 10 percent by weight to about 99 percent by weight although the amounts can be outside of this range. An antistatic agent, biocide and/or filler may be included in the coating 99. The coating 99 may also contain a lightfastness material for minimizing color degradation due to UV light. The coating 99 used as the toner receiving layer is present on the substrate 25 in any effective thickness.

In one embodiment the toner receiving layer present on the transparent substrate is comprised of a polyester binder present in an amount of from about 98.5 percent by weight to about 55 percent by weight, a traction inducing agent that enables the transparency to feed through the copier/printer, present in an amount of from about 0.5 percent by weight to about 5 percent by weight, an antistatic agent present in an amount of from about 0.5 percent by weight to about 20 percent by weight, a lightfastness inducing composition present in an amount of from about 0.5 percent by weight to about 20 percent by weight.

Typically, the total thickness of the coating layer is from about 0.1 to about 25 microns and preferably from about 0.5 to 10 microns, although the thickness can be outside of these ranges.

A coating 100 comprised of a polyester binder material as one of its constituent is present on one side of the backing substrate 98 in any effective thickness. Typically, the total thickness of the coating layer is from about 0.1 to about 25 microns and preferably from about 0.5 to 10 microns, although the thickness can be outside of these ranges.

In the first coating composition 100, the binder can be present within the coating in any effective amount; typically the binder or mixture thereof are present in amounts of from about 5 percent by weight to about 95 percent by weight although the amounts can be outside of this range. The low molecular weight adhesion promoting and polyester compatible compound or mixture thereof are present in an amount of from about 1 percent by weight to about 60 percent by weight. The antistatic agent or mixture thereof are present in the first coating composition in amounts of from about 0.5 percent by weight to about 20 percent by weight although the amounts can be outside of this range. The lightfastness inducing compounds or mixture thereof are present in the first coating of the backing substrate in amounts of from about 0.5 percent by weight to about 20 percent by weight although the amounts can be outside of this range.

In one embodiment the polyester adhesive composition 100 present on one surface of the backing substrate is comprised of a polyester resin present in an amount of from about 95 percent by weight to about 10 percent by weight, a low molecular weight adhesion promoting and polyester compatible compound, present in an amount of from about 4 percent by weight to about 50 percent by weight, an antistatic agent present in an amount of from about 0.5 percent by weight to about 20 percent by weight, a lightfastness inducing composition present in an amount of from about 0.5 percent by weight to about 20 percent by weight.

A second coating 102 applied to the first coating 100 comprises a monomeric ester compound that is compatible with the polyester resin selected as the toner resin, the toner receiving layer resin as well as the backing substrate resin. The purpose of the second coating is to prevent the adhesive binder from being active until it is exposed to heat and pressure. Moreover, the second coating is a wetting agent which effects spreading of the writing materials on the transparent substrate 25.

A third coating 104 which is applied to the opposite side or surface (i.e. the side opposite the side to be adhered to the imaged transparency) of the backing substrate 98 and also to the non-imaged surface of the transparent substrate 25. Includes a material which is a hydrophobic scuff/abrasion resistant polymeric binder such as the polyester resin selected as the toner resin, the toner receiving resin as well as the backing substrate resin, an antistatic agent such as quaternary ammonium salts, a light fastness inducing agent such as, 2-hydroxy-4-(octyloxy)benzophenone, 2-(4-benzoyl-3-hydroxyphenoxy)ethylacrylate and the like and light color filler pigment particles such as colloidal silica. The third 104 coating comprises a hydrophobic scuff/abrasion resistant, anti-slip, filled polymeric coating containing adequate amounts of light color filler pigment particles on the backing substrates such that they can be written upon using pen or pencil as well as being receptive to xerographic imaging. To this end, the light color filler pigment particles is present in the composition 104 in an amount equal to at least 10%.

In one embodiment the abrasion resistant coating 104 is comprised of from about 89 percent by weight to about 20 percent by weight of the binder or mixture thereof, from about 0.5 percent by weight to about 20 percent by weight of the antistatic agent or mixture thereof, from about 0.5 percent by weight to about 20 percent by weight of the lightfastness inducing agent or mixture thereof, and from about 10 percent by weight to about 40 percent by weight of the filler or mixture thereof.

The coating 104 used as the abrasion resistant coating on the backside of the backing substrate 98 and on the non-imaged surface of side of the transparent substrate 25 is present on the substrate in any effective thickness. Typically, the total thickness of the coating layer is from about 0.1 to about 25 microns and preferably from about 0.5 to 10 microns, although the thickness can be outside of these ranges.

Examples of suitable polyester binder polymers for use as coating 99, 100 and 104 for adhering backing substrates to imaged transparent substrates include: biodegradable polyester resins such as polyglycolide, available as Dexon from American Cyanamid Company, polyesters of lactic acid such as polyglactin 910, Vicryl XLG, both being available from Ethicon Company; water soluble polyesters such as titanium derivatives of polyesters such as Tyzor available from E.I. DuPont de Nemours and Company; polyester latex such as Eastman AQ 29D available from Eastman Chemical Company; polyethylene terephthalate resins such as those available as Rynite from E.I. DuPont de Nemours and Company, available as Petlon from Mobay Chemicals, available as Ropet from Rohm and Haas Company, available as Petra from Allied Corporation; Aropol polyester resins such as #Q-6585, #7021, #7030, #7131, #7221, #7320-1, #7362, #7420, #7721, #8022, #8310, #8319, #8420, all being available from Ashland Chemical Company; Hetron polyester resins such as #72, #72-G, #72-L, #72-S, #92-AT, #92-FR, #92-FS, #197-3, #197-A, #197-AT, #197-P, #670-P, #700, #700, #670-C, #900, #922#980, all being available from Ashland Chemical Company; polyarylates resins such as Ardel D-100, available from Union Carbide Company, Durel available from Celanese Corporation; polybutylene terephthalate based ester resins such as Gafite thermoplastic polyester resins such as #1600-A, #1602-Z, #1602-F, all being available from GAF Corporation, Tenite and Eastman MB DA003, available from Eastman Performance Plastics, Hostadur available from Hoechst, Celanex available from Celanese Corporation, Valox available from General Electric Company, Pocan available from Mobay Chemical Company, Arnite A, Arnite B, available from Akzo Plastics BV, Rynite available from E.I. duPont de Nemours and Company Incorporated, Ultradur B4306, Ultradur B4520, available from BASF AG, unsaturated polyester resins such as #40(4), #50, #188, #200-40-80-DAP, #332-65-S(5), #433-70-S#500, #600, #757-75-VTC, all being available from P. D. George Company; Cleartuf polyester resins such as #1006, #7204, #7207, #7800G, #8002, #8006, #8009GG, #8401, #8403, all being available from Goodyear Chemicals; Vitel polyester resins such as #PE-200, #PE-200D, #PE-222, #PE-307, VPE-4302A, VPE-4583A, VPE-4709A, VPE-4751A, VPE-5006A, VPE-5126A, VAR-5126A, VAR-5146A, VPE-5545A, VPE-5571A, VPE-5571AG, VPE-5802A, VPE-5829A, VPE-5833A, VPE-5987A, VPE-6054A, VPE-6104A, VAR-5571AG, VPE-6158A, VPE-6159A, VPE-6467A, VPE-10,022A, VPE-10,035A, VPE-10,038A, all previously sold by Goodyear Chemicals; Flexclad polyester resins such as #V PE-100, VPE-4670A, VPE-5253C, VAR-5825C, VAR-5825F, VPE-6402B, all previously sold by Goodyear Chemicals; Vituf polyester resins such as #5901, #6200, #6400, #6408, #6409, #7004, #7006, #7201, #9501, #9502, #9503, #9504, all previously sold by Goodyear Chemicals; new Vitel 1000 series, Vitel 2000 series, Vitel 3000 series, Vitel 4000 series, Vitel 5000 series presently being sold by Shell Chemical Company, Polymac polyesters such as #918, #919, #920, #922, #923, #924, #925, #927, #929, #930, #931, #981, all being available from Mcwhorter; Bisphenol-A fumarate polyester resins such as #E-750, #E-750-1, #E-751, #E-752, #E-753, #E-764, #E-5297, all being available from Owens-Corning Fibreglass Corporation; Rosin modified maleic polyester resins such as #PA-55-004, #PA-55-011, #PA-55-012, #PA-55-013, PA-55-023, #PA-55-024, #PA-55-025, #PA-55-030, #PA-55-048, #PA-55-164, #PA-55-360, #PA-55-361, PA-55-364, all being available from Polymer Applications Incorporated; polyester resins S-series, and flame retardant F-series, all being available from Silmar Division of Vistron Corporation; polyester adipate such as Merrol P-Series such as #P-6303, #P-6310, #P-6311, #P-6320, #P-6403, #P-6410, #P-6420, #P-6422, #P-6424, available from Merrand International Corporation; polyester azelate, available as Merrol #P-9500 and #P-1030 LV, from Merrand International Corporation; polyester glutarate, available as Merrol #P-5510, from Merrand International Corporation; polyester nylonate, available as Merrol #P-5511, from Merrand International Corporation; polyester phthalate, available as Merrol #P-8425, from Merrand International Corporation; polyester polyol, available as Terate #202, #203, #204, from Hercules Incorporated; low melt polyesters including poly(ethylene adipate) such as #147, available from Scientific Polymer Products, poly(ethylene succinate) such as #149, available from Scientific Polymer Products, poly(ethylene azelate) such as #842, available from Scientific Polymer Products, poly(1,4-butylene adipate) such as #150, available from Scientific Polymer Products, poly(trimethylene adipate) such as #594, available from Scientific Polymer Products, poly(trimethylene glutarate) such as #591 available from Scientific Polymer Products, poly(trimethylene succinate) such as #592, available from Scientific Polymer Products poly(hexamethylene succinate) such as #124 available from Scientific Polymer Products, poly(diallyl phthalate) such as #010 available from Scientific Polymer Products, poly (diallyl isophthalate) such as #011 available from Scientific Polymer Products, thiodipropionate polyester available as TDP 2000, from Eastman Chemicals company; polyester resin, available as Admex Series from Sherex Polymer Incorporated; Resapol HT linear polyester, available from Rezana Brazil; crosslinked Resapol HT, with a degree of cross-linking ranging between 5 to about 40 percent, obtained via reactive extrusion process as described in U.S. Pat. No. 5,227,460 assigned to Xerox Corporation with H. Mahabadi and et al as the listed inventors; polyester-ether resins such as those available as Hytrel from E.I. DuPont de Nemours and Company, available as Lomod from General Electric Company, available as Gaflex from GAF Corporation, available as Kodar PETG 6763 and Kodar CTPI from Eastman Chemicals, available as Arnitel from Akzo Plastics BV, available as Pelprene from Toyobo Company, available as Ecdel from Eastman Kodak Company; polyester-co-polycarbonate resins available as APE KLI-9306, APE KLI-9310, available from Dow Chemical Company, available as Lexan 3250, Lexan -PPC, from General Electric Company, available as Copec from Mitsubishi Chemical Industries, Ltd, and Allied Chemical Corporation, available as XP-73, from Dow Chemical Company, available as Apec from Farbenfabriken Bayer AG; cellulose esters such as cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, cellulose acetate butyrate, such as #077, available from Scientific Polymer Products, cellulose propionate such as #2052, available from Scientific Polymer Products, and mixtures thereof.

Biodegradable polyglycolide, polyglactin, water soluble polyesters, polyester latex Eastman AQ 29D, are preferred because these are environment friendly. Vitel Goodyear polyester resins such as #VPE-5126A, #VAR-5126A, #VAR-5571AG, #VPE-10, 035A, Flexclad polyester resins such as #VAR-5825C, VAR-5825F, Resapol HT linear polyester, available from Rezana Brazil; crosslinked Resapol HT with a degree of cross-linking ranging between 5 to about 40 percent, obtained via reactive extrusion process as described in U.S. Pat. No. 5,227,460 assigned to Xerox Corporation with H. Mahabadi and et al as the listed inventors; are preferred because of their low melt temperatures.

In addition, the coatings 99, 100, 104 may contain adhesion promoting low molecular weight ester compatible compounds including: (1) isobutyl palmitate, Kessco IBP; methyl stearate, Stepan C 66; methyl myristate, Stepan C 50; methyl oleate, Stepan C 68; octyl oxystearate, Kessco octyl oxystearate; octyl palmitate, Kessco octyl palmitate; all being available from Stepan Company, (2) ethyl pelargonate, Carsemol A-500; glyceryl mono/dilaurate, Aldo ML; glyceryl mono/dioleate Aldo MO; all being available from Lonza Incorporated, (3) acetylated sucrose distearate, Crodesta A-10, Crodesta A-20; cetearyl lactate, Crodamol CSL; cetearyl octanoate, Crodamol CAP; cetearyl palmitate, Crodamol CSP; cetearyl stearate, Crodamol CSS; glyceryl tribehenate, Syncrowax HR-C, Syncrowax HRS-C; glyceryl dilaurate, Cithrol GDL N/E, Cithrol GDL S/E; glyceryl dioleate, Cithrol GDO N/E, Cithrol GDO S/E; glyceryl distearate, Cithrol GDS N/E, Cithrol GDS S/E; glycol dilaurate, Cithrol EGDL N/E, Cithrol EGDL S/E; glycol dioleate, Cithrol EGDO N/E, Cithrol EGDO S/E; glycol distearate, Cithrol EGDS N/E, Cithrol EGDS S/E; glycol oleate, Cithrol EGMO N/E, Cithrol EGMO S/E; glycol ricinoleate, Cithrol EGMR N/E, Cithrol EGMR SIE; glycol stearate, Cithrol EGMS N/E, Cithrol EGMS S/E; pentaerythritol tetra caprylate/caprate, Crodamol PTC; pentaerythritol tetra isostearate, Crodamol PTIC; propylene glycol dicaprylate, Crodamol PC; stearyl heptanoate, Crodamol W; sucrose cocoate, Crodesta SL-40; sucrose distearate, Crodesta F-10, Crodesta F-50, Crodesta F-110; all being available from Croda Incorporated, (4) dibutyl maleate, Staflex DBM; dibutyl fumarate, Staflex DBF; diisononyl adipate, Staflex DINA; diisononyl maleate, Staflex DINM; diisooctyl adipate, Staflex DIOA; diisooctyl maleate, Staflex DIOM; diisooctyl phthalate, Staflex DIOP; dimethyl phthalate, Staflex DMP; dioctyl adipate, Staflex DOA; dioctyl azelate, Staflex DOZ; dioctyl fumarate, Staflex DOF; dioctyl maleate, Staflex DOM; diisooctyl phthalate Staflex DIOP; ditridecyl maleate Staflex DTDM; ditridecyl phthalate, Staflex DTDP; n-octyl-n-decyl adipate, Staflex NODA; n-octyl-n-decyl phthalate, Staflex ODP; n-octyl-n-decyl trimellitate, Staflex NONDTM; all being available from Reichhold Chemicals Incorporated, (5) distearyl phthalate, Radiasurf 7505; 2-ethylhexyl laurate, Radia 7127; 2-ethylhexyl oleate, Radia 7331; glyceryl capromyristate, Radia 7104; glyceryl hydroxy stearate, Radiasurf 7146; glyceryl oleate, Radiasurf 7150, Radiasurf 7151SE; glyceryl stearate, Radiasurf 7140, Radiasurf 7141SE; glyceryl ricinoleate, Radiasurf 7153, glyceryl tricaprate/caprylate, Radianol 2106, Radianol 7106; glyceryl triheptanoate, Radianol 7376; isononyl oleate, Radia 7330; isononyl stearate, Radia 7510; isooctyl stearate, Radia 7130, Radia 7131; isopropyl myristate, Radia 7190; isopropyl myristo palmitate, Radia 7220; isopropyl oleate, Radia 7231; isopropyl palmitate, Radia 7200; pentaerythritol tetrabehenate, Radia 7514; pentaerythritol tetra C5/C9, Radiasyn 7174; pentaerythritol tetra C7, Radiasyn 7177; pentaerythritol tetra C8/C10, Radiasyn 7178; pentaerythritol tetraoleate, Radia 7171; pentaerythritol tetrastearate, Radia 7176; propyleneglycol myristate, Radiasurf 7196; propyleneglycol oleate, Radiasurf 7206; all being available from, Belgium, (6) butoxyethyl oleate, Merrol 4218; dibutoxyethoxy ethyl adipate, Merrol 4226; dibutoxyethoxy ethyl phthalate, Merrol 4228; dibutoxyethoxy ethyl sebacate, Merrol 4226; dibutoxyethoxy ethyl phthalate, Merrol 4220; dibutoxy ethyl adipate, Merrol 4206; dibutoxy ethyl phthalate, Merrol 4208; dibutoxy ethyl sebacate, Merrol 4200; diisodecyl nylonate/glutarate, Merrol DIDN; diisooctyl adipate, Merrol DIOA; epoxidized tallate, Merrol E-45; glycol ether glutarate, Merrol 4425; tri n-hexyl trimellitate, Merrol 600TM; triisooctyl trimellitate, Merrol TIOTM; all being available from Merrand International Corporation, (7)

dibutyl phthalate, Unimoll DB; dibutyl sebacate Unimate DBS; dicyclohexyl phthalate, Unimate 66-M; all being available from Bayer A.G. Germany, (8) diallyl fumarate, SR-204 available from Sartomer Company, (9) diallyl phthalate, Cadox M-30 available from Akzo Chemicals Incorporated, (10) diisodecyl phthalate, Vinyzene Bp-505 DIDP available from Morton International, (11) dimethyl adipate, DBE-2, DBE-3, DBE-9; dimethyl succinate, DBE-4, available from E.I. duPont, de Nemours and Company Incorporated, (12) dicapryl adipate, Uniflex DCA; dicapryl phthalate, Uniflex DCP; both being available from Union Camp Corporation, (13) dimethoxy ethyl phthalate, Kodaflex DMEP; dioctyl terephthalate, Kodaflex DOTP; trioctyl trimllitate, Kodaflex TOTM; being available from Eastman Chemical Company, (14) butyl ammonium caprylate, Rewocor BAC; isopropyl lanolate Rewolan LP; glycol dibehenate, Rewopal PG 340; all being available from Rewo Chemische Werke GmbH, Germany, (15) dibutoxyethoxy ethyl glutarate, Plasthall DBEEG; dibutoxy ethyl azelate, Plasthall DBEZ; dibutoxy ethyl glutarate, Plasthall DBEG; diisobutyl adipate, Plasthall DIBA; diisobutyl azelate, Plasthall DIBZ; diisodecyl adipate, Plasthall DIDA; diisooctyl dodecanedioate, Plasthall DIODD; dioctyl dodecanedioate dioleate, Plasthall DODD; dioctyl sebacate, Plasthall DOS; epoxidized glycol dioleate Monoplex S-75; all being available from C.P. Hall Company, (16) isodecyl oleate, Ceraphyl I 40-A; octyl dodecyl stearoyl stearate, Ceraphyl 847; tridecyl neopentanoate, Ceraphyl 55; available from Van Dyk, division of Mallinckrodt company, (17) glyceryl linoleate, Grindtek MOL 90; glyceryl myristate, Grindtek MM 90; available from Grindsted Products Incorporated, (18) batyl isostearate, Nikkol-18 IS; glyceryl trioctanoate, Nikkol-trifat S-308; both being available from Nikko Chemical Company, (19) dioctyl dilinoleate, Kemester 3681; ditridecyl adipate, Kemester 5654; ditridecyl dilinoleate, Kemester 3684; methyl eicosonate, Kemester 2050; methyl soyate, Kemester 226; methyl tallowate, Kemester 143; methyl oleate/linoleate, Kemester 213; triisocetyl citrate, Hetester TICC; tetrahdrofurfuryl oleate, Kemester THFO; all being available from Witco/Humko company, (20) beheny erucate, Schercemol BE; cetyl lactate, Schercemol CL; cetyl myristate, Schercemol CM; cetyl octanoate, Schercemol CO; cetyl palmitate, Schercemol CP; cetyl stearate, Schercemol CS; decyl isostearate, Schercemol DEIS; decyl oleate, Schercemol DO; diisocetyl adipate, Schercemol DICA; diisopropyl adipate, Schercemol DIA; diisopropyl dimerate, Schercemol DID; diisopropyl sebacate, Schercemol DIS; diisostearyl dilinoleate, Schercemol DISD; erucyl erucate, Schercemol SE; isostearyl erucate, Schercemol; isostearyl/erucyl erucate, Scheroba oil; isostearyl isostearate, Schercemol 1818; isostearyl neopentanoate, Schercemol 185; isostearyl stearoyl stearate, Schercemol 1SS; myreth-3-laurate, Schercemol MEL-3; myreth-3-myristate, Schercemol MEM-3; myreth-3-palmitate, Schercemol MEP-3; myristyl lactate, Schercemol ML; myristyl myristate, Schercemol MM; myristyl propionate, Schercemol MP; myristyl stearate, Schercemol MS; octyl pelargonate, Schercemol OPG; propylene glycol dipelargonate, Schercemol PGDP; propylene glycol laurate, Schercemol PGML; propylene glycol stearate, Schercemol PGMS; triisopropyl trilinoleate, Schercemol TT; triisostearyl trilinoleate, Schercemol TIST; all being available from Scher Chemicals Incorporated, (21) glyceryl tris-12-hydroxy stearate, Cutina BW; cetearyl isononanoate, Cetiol SN; dibutyl adipate, Cetiol B, Rilanit DBA; dihydrogenated tallow phthalate, Rilanit DTP; diisotridecyl phthalate, Edenol W 300S; dimethyl azelate, Emery 2914; 2-ethylhexyl tallowate, Rilanit EHTI; glyceryl isostearate, Emmerest 2410; isobutyl oleate, Rilanit IBO; isobutyl stearate, Rilanit IBS; isobutyl tallowate, Rilanit IBTI; methyl dimerate, Emery 2902; myristyleicosyl stearate, Standmul G-3236 stearate; octadodecanol stearate Cetiol G 20S; oleyl erucate Cetiol J 600; oleyl oleate Rilanit OLO; pentaerythritol tetrapelargonate, Emerest 2485 Emerest 2486; propylene glycol dicaprylate/caprate, Standmul 302; propylene glycol isostearate, Emerest 2384; triethanolamine dioleate, Rilanit TDO; trihydroxy methoxy stearin, Cetiol R; stearoyl stearate, Rilanit STS-T; all being available from Henkel corporation, (22) caprylic/capric diglyceryl succinate, Miglyol 829; caprylic/capric glycerides, Imwitor 742; caprylic/capric/isostearic/adipic triglycerides, Softisan 649; caprylic/capric/linoleic triglycerides, Miglyol 818; caprylic/capric triglycerides, Miglyol 810; caprylic/capric/stearic triglycerides, Softisan 378; glyceryl caprate, Imwitor 310; glyceryl caprylate, Imwitor 308; glyceryl mono/dicaprylate, Imwitor 908; glyceryl mono/dimyristate, Imwitor 914; glyceryl stearate palmitate, Imwitor 940K; glyceryltrilaurate/stearate, Softisan Hard Fats; Tripalmitin, Dynasam 116; all being available from Huls America Incorporated, (23) caprylic triglyceride, Captex 8000; caprylic/capric/lauric triglycerides, Captex 350; glyceryl trioleate, Acconom GTO; glyceryl tristearate, Captex 5380; all being available from Capital City Products Company, (24) arachidyl behenate, Waxenol 822; arachidyl propionate, Waxenol 801; butylacetyl ricineolate, Flexricin P-6; butylacetoxy stearate, Paricin 6; cetyl ricinioleate, Nature Chem CR; glyceryltriacetyl hydroxystearate, Paricin 8; glyceryl triacetyl ricinioleate, Paricin 8; isodecyl isononanoate, Wickenol 152; isononyl isononanoate, Wickenol 151; isopropyl isostearate, Wickenol 131; methyl ricinioleate, Flexricin P-1; methyl octanoate, Wickenol 174; pentaerythritol ricinioleate, Flexricin 17; propyleneglycol hydroxystearate, Paricin 9; propyleneglycol ricinioleate, Flexricin 9; all being available from Cas Chem Incorporated, (25) octadodecyl myristate, Exceparl OD-M; octadodecyl oleate, Exceparl OD-OL; sorbitan distearate, Emaasol S-20; all being available from Kao Corporation, (26) sorbitan esters such as sorbitan isostearate, S-Maz-67; sorbitan laurate, S-Maz-20; sorbitan palmitate, S-Maz-40; sorbitan oleate, S-Maz-80; sorbitan sesquioleate, S-Maz-83R; sorbitan sesquitallate, S-Maz-93R; sorbitan stearate, S-Maz-60; sorbitan tallate, S-Maz-90; sorbitan trioleate, S-Maz-85; sorbitan tristearate, S-Maz-65; sorbitan tritallate, S-Maz-95; propyleneglycol distearate, Mapeg PGDS; all being available from PPG-Mazer, division of PPG Chemicals Corporation, sorbitan myristate, Nissan Nonion MP-30R available from Nippon oils and Fat company, (27) glyceryl trilaurate, Cyclochem GTL; glyceryl triisostearate, Cyclochem GTIS; available from Rhone and Poulenc Corporation, (28) behenoxy dimethicone, Abil-Wax 2440; cetyl isooctanoate, Tegosoft 168; isooctadecyl isononanoate, Tegosoft 169; all being available from TH. Goldschmidt AG. Germany, (29) glyceryl di/tri palmito stearate, Precirol ATO; glyceryl di/tri tristearate, Precirol WL 2155; both being available from Gatte Fosse Company, (30) octadecyl stearate, Starfol ODS; octyl dodecyl stearate, Starfol OS; both being available from Sherex Chemical Company, (31) glyceryl hydrogenated rosinate, Foral 85; glyceryl rosinate, Poly-pale-ester 10; methyl hydrogenated rosinate, Hercolyn D; pentaerythritol hydrogenated rosinate, Pentalyn H; pentaerythritol rosinate, Pentalyn 830, Pentalyn 856-A, all being available from Hercules Incorporated, (32) glucose esters methyl gluceth-20 distearate, Glucam E-20; methyl glucose dioleate, Glucate DO; methyl glucose sesquistearate, Glucate SS; oleyl linoleate, Polylan; all being available from Amerchol Corporation, (33) sucrose esters such as sucrose di/tristearate, Ryoto Sugar Ester S-170,S-270,S-370; sucrose laurate, Ryoto Sugar Ester LWA-1540; sucrose mono/distearate, Ryoto Sugar Ester S-970,S-1170; sucrose oleate, Ryoto Sugar Ester OWA-1570; sucrose palmitate, Ryoto Sugar Ester P-1570,P-1670; sucrose stearate, Ryoto Sugar Ester S-1570,S-1670; all being available from Ryoto Company, (34) isostearyl lactate, Patlac IL available from RITA Corporation, (35) 1,4-cyclohexane dimethanol dibenzoate, Benzoflex 352; glyceryl tribenzoate, Benzoflex S-304; pentaerythritol tetrabenzoate, Benzoflex S-552; propylene glycol dibenzoate, Benzoflex 284; all being available from Velsicol Chemical Company, (36) cumyl-phenyl benzoate, Kenplast ESB; cumyl-phenyl neodecaonoate, Kenplast ESN; both being available from Kenrich Petrochemical Company; and mixtures thereof.

Adhesion promoting low molecular weight ester compounds such as sorbitan esters, glucose esters, sucrose esters, acetylated sucrose distearate, cetearyl lactate, isostearyl lactate, are preferred because these are environment friendly. Wax like compounds from oils such as arachidyl behenate, arachidyl propionate, butylacetyl ricineolate, butylacetoxy stearate, cetyl ricinioleate, glyceryltriacetyl hydroxystearate, glyceryltriacetyl ricinioleate, isodecyl isononanoate, isononyl isononanoate, isopropyl isostearate, methyl ricinioleate, methyl octanoate, pentaerythritol ricinioleate, propyleneglycol hydroxystearate, propyleneglycol ricinioleate, behenoxy dimethicone, are preferred as these are derived from oils. Other materials such as benzoates such as 1,4-cyclohexane dimethanol dibenzoate, glyceryl tribenzoate, pentaerythritol tetrabenzoate, propylene glycol dibenzoate, cumyl-phenyl benzoate, cumyl-phenyl neodecaonoate, are preferred as these act as preservatives as well.

In addition, the coatings 99,100, may contain polyester crosslinking agents including peroxy compounds such as t-butylperoxy crotonate Esperox 13M; t-butylperoxy neodecanoate Esperox 33M; t-butylperoxy neoheptanoate Esperox 750M; t-butylperoxy piviate Esperox 31M; tert-butylperoxy 2-methylbenzoate, Esperox 497M; all being available from Witco/Argus Chemicals; tert-butyl peroxyneohexanoate Lupersol 750M; tert-butyl peroctate Lupersol P-31, Lupersol PDO, Lupersol PMS; α-cumyl peroxyneodecanoate Lupersol 188M75; α-cumyl peroxyneoheptanoate Lupersol 288M75; α-cumyl peroxy pivalate Lupersol 47M75; di-tert-butyl diperoxy azelate Lupersol 99; di-tert-butyl diperoxy phthalate Lupersol KDB; 1,1-dimethyl-3-hydroxybutylperoxy-2-ethyl hexanoate Lupersol 665T50; 1,1-dimethyl-3-hydroxybutylperoxyneoheptanoate Lupersol-677T50; dioctyl peroxy dicarbonate, Lupersol 223, Lupersol 223-M, Lupersol 223-M 40, Lupersol 223-M 75, Lupersol 223-T70, all being available from ATO Chem, France; and mixtures thereof.

In addition, the coatings 99, 100, 102, 104 contain lightfastness inducing agents including UV absorbing compounds including glycerol 4-amino benzoate, available as Escalol 106 from Van Dyk Corporation; resorcinol mono benzoate, available as RBM, from Eastman Chemicals; octyl dimethyl amino benzoate, available as Escalol 507 from Van Dyk Corporation; hexadecyl-3,5-di-tert-butyl-4-hydroxybenzoate, available as Cyasorb UV-2908, #41,320-8, from Aldrich chemical company; octyl salicylate, available as Escalol 106 from Van Dyk Corporation; octyl methoxy cinnamate, available as Parasol MCX, from Corporation; 4-allyloxy-2-hydroxybenzophenone, available as Uvinul 600 #41,583-9, from Aldrich chemical company; 2-hydroxy-4-methoxy benzophenone, available as Anti UVA, from Acto Corporation; 2,2'-dihydroxy-4,4'-dimethoxy benzophenone, available as Uvinul D49, #D11,100-7, from Aldrich chemical company; 2-hydroxy-4-(octyloxy)benzophenone available as Cyasorb UV-531, #41,315-1, from Aldrich chemical company; 2-hydroxy-4-dodecyloxy benzophenone, available as DOBP, from Eastman Chemicals; 2-(2'-hydroxy-5'-methylphenyl) benzotriazole, available as Tinuvin 900, from Ciba Geigy Corporation; 2-[2'-hydroxy-3,5-di-(1,1-dimethyl Benzes) phenyl]-2H-benzo triazole, available as Topanex 100BT, from ICI America Corporation; bis[2-hydroxy-5-tert-octyl-3-(benzotriazol-2-yl)phenyl methane, available as Mixxim BB/100, from Fairmount-Corporation; 2-(3',5'-di-tert-butyl-2'-hydroxyphenyl)-5-chlorobenzo-triazole, available as Tinuvin 327, from Ciba Geigy Corporation; 2-(4-benzoyl-3-hydroxyphenoxy)ethylacrylate (Cyasorb UV-416, #41,321-6, available from Aldrich chemical company), poly[2-(4-benzoyl-3-hydroxyphenoxy)ethylacrylate] (Cyasorb UV-2126, #41,323-2, available from Aldrich chemical company), N-(4-ethoxycarbonyl phenyl)-N'-ethyl-N'-phenyl formadine, available as Givesorb UV-2, from Givaudan-Corporation; 1,1-(1,2-ethane-diyl)-bis(3,3,5,5-tetramethyl piperazinone), available as Good-rite UV 3034, from Goodrich chemicals; tris(3,5-di-tert-butyl-4-hydroxybenzyl) isocyanurate, available as Good-rite UV 3114, from Goodrich-chemicals; nickel-bis(o-ethyl(3,5-di-tert-butyl-4-hydroxybenzyl)phosphonate, available as Irgastab 2002, from Ciba Geigy Corporation; [2,2,6,6-tetramethyl-4-piperidinyl)-1,2,3,4-butane tetracarboxylate, available as Mixxim HALS 57, from Fairmount Corporation; [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 68, from Fairmount Corporation; [1,2,2,6,6-pentamethyl-4-piperidinyl/β,β,β',β'-tetramethyl-3,9-(2,4,8,10-tetraoxospiro(5,5) undecane)diethyl]-1,2,3,4-butanetetracarboxylate, available as Mixxim HALS 63, from Fairmount Corporation; 2-dodecyl-N-(2,2,6,6-tetramethyl-4-piperidinyl) succinimide, available as Cyasorb UV-3581, #41,317-8, from Aldrich chemical company); 2-dodecyl-N-(1,2,2,6,6-pentamethyl-4-piperidinyl)succinimide, available as Cyasorb UV-3604, #41,318-6, from Aldrich chemical company; N-(1-acetyl-2,2,6,6-tetramethyl-4-piperidinyl)-2-dodecyl-succinimide, available as Cyasorb UV-3668, #41,319-4, from Aldrich chemical company; tetrasodium-N-(1,2-dicarboxyethyl)-N-octadecyl-sulfosuccinamate, available as Aerosol 22N, from American Cyanamid Corporation; nickel dibutyldithiocarbamate, available as UV-Chek AM-105, from Ferro Corporation; poly(4-hydroxy-2,2,6,6-tetramethyl-1-piperidine ethanol/dimethyl succinic acid), available as Tinuvin 622LD, from Ciba-Geigy Corporation; poly(3,5-di-tert-butyl-4-hydroxy hydrocinnamic acid ester/1,3,5-tris(2-hydroxyethyl)-5-triazine-2,4,6(1H,3H,5H)-trione, available as Good-rite 3125, from Goodrich Chemicals; poly[N,N-bis(2,2,6,6-tetramethyl-4-piperidinyl)-1,6-hexanediamine-co-2,4-dichloro-6-morpholino-1,3,5-triazine), available as Cyasorb UV-3346, #41,324-0, from Aldrich chemical company; 1-[N-[poly(3-allyloxy-2-hydroxypropyl)-2-aminoethyl]-2-imidazolidinone, #41,026-8 available from Aldrich chemical company; poly(2-ethyl-2-oxazoline) #37,284-6, #37,285-4, #37,397-4, available from Aldrich chemical company.

Further, the coatings 99, 100, 102, 104 contain lightfastness inducing antioxidant compounds such as didodecyl-3,3'-thiodipropionate, available as Cyanox LTDP, #D12,840-6, from Aldrich chemical company; ditridecyl-3,3'- thiodipropionate, available as Cyanox 711, #41,311-9, from Aldrich chemical company); ditetradecyl-3,3'-thiodipropionate, available as Cyanox MTDP, #41,312-7, from Aldrich chemical company; dicetyl-3,3'-thiodipropionate, available as Evanstab 16 from Evans Chemetics Corporation; dioctadecyl-3,3'-thiodipropionate, available as Cyanox STDP, #41,310-0, from Aldrich chemical company; triethyleneglycol-bis[3-(3'-tert-butyl-4'-hydroxy-5'-methylphenyl) propionate], available as Irganox 245, from Ciba-Geigy Corporation; octadecyl-3-(3,5-ditert-butyl-4-hydroxy phenyl) propionate, available as Ultranox 276, from General Electric Company; 1,6-hexamethylene-bis(3,5-di-tert-butyl-4-hydroxy hydrocinnamate),available as Irganox 259, from Ciba-Geigy Corporation; tetrakis [methylene(3,5-di-tert-butyl-4-hydroxy hydrocinnamate), available as Irganox 1010, from Ciba-Geigy Corporation; thiodiethylenebis(3,5-di-tert-butyl-4-hydroxy) hydrocinnamate, available as Irganox 1035, from Ciba-Geigy Corporation; octadecyl-3,5-di-tert-butyl-4-hydroxy hydrocinnamate, available as Irganox 1076, from Ciba-Geigy Corporation; N,N'-hexamethylenebis(3,5-di-tert-butyl-4-hydroxy hydrocinnamide), available as Irganox 1098, from Ciba-Geigy Corporation; 2,2-bis[4-(2-(3,5-di-tert-butyl-4-hydroxyhydro cinnamoyl oxy))ethoxy phenyl] propoane, available as Topanol 205, from ICI America Corporation; N-stearoyl-4-aminophenol, available as Sucnox-18, from Hexcel Corporation; 2,6-di-tertbutyl-4-methyl phenol, available as Ultranox 226, from General Electric company; 2,6-di-tert-butyl-4-cresol, available as Vulkanox KB, from Mobay Chemicals; 2,6-di-tert-butyl-α-dimethylamino-4-cresol, available as Ethanox-703, from Ethyl Corporation; 2,2'-isobutylidene-bis(4,6-dimethylphenol), available as Vulkanox NKF, from Mobay Chemicals; 2,2'-methylenebis(6-tert-butyl-4-methyl phenol), available as Cyanox 2246, #41,315-5, from Aldrich chemical company; 2,2'-methylene bis(6-tert-butyl-4-ethylphenol), available as Cyanox 425, #41,314-3, from Aldrich chemical company; tris(4-tert-butyl-3-hydroxy-2,6-dimethylbenzyl) isocyanurate, available as Cyanox 1790, #41,322-4, LTDP, #D12,840-6, from Aldrich chemical company; 1,3,5-trimethyl-2,4,6-tris(3,5-di-tert-butyl-4-hydroxybenzyl) benzene, available as Ethanox 300, #41,328-3, from Aldrich chemical company; triphenyl phosphite, available as Lankromark LE65, from Harcros Corporation; tris (nonylphenyl)phosphite, available as Lankromark LE109, from Harcros Corporation; tris (2,4-di-tert-butyl-phenyl)phosphite, available as Wytox 240 from Olin Corporation; 2,2'-ethylidene-bis(4,6-di-tert-butylphenyl) fluorophosphonite, available as Ethanox 398, from Ethyl Corporation; octylated diphenylamine, available as Anchor ODPA, from Anchor Corporation; N,N'-β,β'-naphthalene-4-phenylenediamine, available as Anchor DNPD, from Anchor Corporation; 4,4'-methylene-bis (dibutyldithiocarbamate), available as Vanlube 7723, from Vanderbilt Corporation; antimony dialkyldithio carbamate, available as Vanlube 73, from Vanderbilt Corporation; antimony dialkylphosphorodithioate, available as Vanlube 622, from Vanderbilt Corporation; molybdenum oxysulfide dithio carbamate, available as Vanlube 622, from Vanderbilt Corporation; 2,2,4-trimethyl-1,2-hydroquinoline, available as Vulkanox HS, from Mobay Corporation; and mixtures thereof.

Further, the coatings 99, 100, 102, 104 contain lightfastness inducing antiozonants such as N-isopropyl-N'-phenyl-phenylenediamine, available as Santoflex IP, from Monsanto Chemicals; N-(1,3-dimethylbutyl)-N'-phenyl-phenylenediamine, available as Santoflex 13, from Monsanto Chemicals; N,N'-di(2-octyl)-4-phenylene diamine, available as Antozite-1, from Vanderbilt Corporation; N,N'-bis (1,4-dimethylpentyl)-4-phenylenediamine, available as Santoflex 77, from Monsanto Chemicals; 2,4,6-tris-(N-1,4-dimethylpentyl-4-phenylenediamino)-1,3,5-triazine, available as Durazone 37, from Uniroyal Corporation; 6-ethoxy-1,2-dihydro-2,2,4-trimethyl quinoline, available as Santoflex AW, from Monsanto Chemicals; bis-(1,2,3,6-tetrahydrobenzaldehyde) pentaerythritol acetal, available as Vulkazon AFS/LG, from Mobay Corporation; Parrafin Wax, available as Petrolite C-700, Petrolite C-1035, from Petrolite Corporation; and mixtures thereof.

Examples of suitable polyglycol ester compounds for use as polyester toner wetting agents of coating 102 include: (1) poly ethylene glycol-A-laurate where A varies from 1 to 200 such as poly ethylene glycol-4-laurate Kessco PEG 200 monolaurate; poly ethylene glycol-32-laurate Kessco PEG 1540 monolaurate; poly ethylene glycol-150-laurate Kessco PEG 6000 monolaurate; all three being available from Stepan Company, (2) poly ethylene glycol-B-oleate where B varies from 1 to 400 such as poly ethylene glycol-4-oleate Kessco PEG 200 monooleate; poly ethylene glycol-32-oleate Kessco PEG 1540 monooleate; poly ethylene glycol-150-oleate Kessco PEG 6000 monooleate; all three being available from Stepan Company, (3) poly ethylene glycol-C-stearate where C varies from 1 to 400 such as poly ethylene glycol-4-stearate Kessco PEG 200 monostearate; poly ethylene glycol-32-stearate Kessco PEG 1540 monostearate; poly ethylene glycol-150-stearate Kessco PEG 6000 monostearate; all three being available from Stepan Company, (4) poly ethylene glycol-D-isostearate where D varies from 1 to 20 such as poly ethylene glycol-4-isostearate Emerest 2625; poly ethylene glycol-8-isostearate Emerest 2644; poly ethylene glycol-12-isostearate Emerest 2664; all three being available from Henkel/Emery Corporation, (5) poly ethylene glycol-E-tallate where E varies from 1 to 220 such as poly ethylene glycol-4-tallate Mapeg-200 MOT; poly ethylene glycol-12-tallate Mapeg-600 MOT; poly ethylene glycol-220-tallate Mapeg-TAO-10; all three being available from PPG-Mazer, division of PPG Chemicals Corporation, (6)) poly ethylene glycol-F-tallowate where F varies from 1 to 30 such as poly ethylene glycol-8-tallowate Lipal TE 43; poly ethylene glycol-22-tallowate Lipal TE 70; poly ethylene glycol-30-tallowate Lipal TE 70; all three being available from, Stepan/PVO Company, (7) poly ethylene glycol-G-dilaurate where G varies from 1 to 200 such as poly ethylene glycol-4-dilaurate Kessco PEG 200 dilaurate; poly ethylene glycol-32-dilaurate Kessco PEG 1540 dilaurate; poly ethylene glycol-150-dilaurate Kessco PEG 6000 dilaurate; all three being available from Stepan Company, (8) poly ethylene glycol-H-dioleate where H varies from 1 to 200 such as poly ethylene glycol-4-dioleate Kessco PEG 200 dioleate; poly ethylene glycol-32-dioleate Kessco PEG 1540 dioleate; poly ethylene glycol-150-dioleate Kessco PEG 6000 dioleate; all three being available from Stepan Company, (9) poly ethylene glycol-I-distearate where I varies from 1 to 400 such as poly ethylene glycol-4-distearate Kessco PEG 200 distearate; poly ethylene glycol-32-distearate Kessco PEG 1540 distearate; poly ethylene glycol-150-distearate Kessco PEG 6000 distearate; all three being available from Stepan Company, (10) poly ethylene glycol-J-ditallate where J varies from 1 to 20 such as poly ethylene glycol-4-ditallate Mapeg-200 DOT; poly ethylene glycol-8-tallate Mapeg-400 DOT; poly ethylene glycol-12-tallate Mapeg-600 DOT; all three being available from PPG-Mazer, division of PPG Chemicals Corporation, (11) poly ethylene glycol-K-glyceryl laurate where K varies from 5 to 30 such as poly ethylene glycol-20-glyceryl laurate Tagat L-2; poly ethylene glycol-30-glyceryl laurate Tagat L; both being available from TH. Goldschmidt AG. Germany, (12) poly ethylene glycol-L-glyceryl oleate where L varies from 5 to 30 such as poly ethylene glycol-20-glyceryl oleate Tagat O-2; poly ethylene glycol-30-glyceryl oleate Tagat O; both being available from TH. Goldschmidt AG. Germany, (13) poly ethylene glycol-M-glyceryl stearate where M varies from 5 to 150 such as poly ethylene glycol-20-glyceryl stearate Tagat S-2; poly ethylene glycol-30-glyceryl stearate Tagat S; both being available from TH. Goldschmidt AG. Germany, (14) poly ethylene glycol-N-glyceryl tallowate where N varies from 5 to 200 such as poly ethylene glycol-20-glyceryl tallowate Varonic LI-42; poly ethylene glycol-200-glyceryl tallowate Varonic LI-420 both being available from Sherex Chemical Company, (15) poly ethylene glycol-O-glyceryl ricinoleate where O varies from 5 to 30 such as poly ethylene glycol-15-glyceryl ricinoleate Tagat R-1 available from TH. Goldschmidt AG. Germany, (16) poly ethylene glycol-P-di-(2-hydroxy ethyl)-5,5-dimethyl hydantoin oleate, where P varies from 5 to 30 such as poly ethylene glycol-5-di-(2-hydroxyethyl)-5,5-dimethyl hydantoin oleate Dantosperse DHE (5) MO; poly ethylene glycol-15-di-(2-hydroxyethyl)-5,5-dimethyl hydantoin oleate Dantosperse DHE (15) MO; both being available from Lonza Incorporated, (17) poly ethylene glycol-Q-sorbitan laurate, where Q varies from 2 to 100 such as poly ethylene glycol-20-sorbitan laurate (polysorbate 20) T-Maz-20; poly ethylene glycol-80-sorbitan laurate T-Maz-28; both being available from PPG-Mazer, division of PPG Chemicals Corporation, (18) poly ethylene glycol-R-sorbitan oleate, where R varies from 2 to 50 such as poly ethylene glycol-5-sorbitan oleate (poly sorbate 81) T-Maz-81; poly ethylene glycol-20-sorbitan oleate (poly sorbate 80) T-Maz-80; both being available from PPG-Mazer, division of PPG Chemicals Corporation, (19) poly ethylene glycol-S-sorbitan stearate where S varies from 2 to 50 such as poly ethylene glycol-4-sorbitan stearate (poly sorbate 61) T-Maz-61; poly ethylene glycol-20-sorbitan stearate (poly sorbate 60) T-Maz-60; both being available from PPG-Mazer, division of PPG Chemicals Corporation, (20) poly ethylene glycol-20-sorbitan esters such as poly ethylene glycol-20-sorbitan palmitate (poly sorbate 40) T-Maz-60; poly ethylene glycol-20-sorbitan-tallate T-Maz-90; poly ethylene glycol-20-sorbitan-trioleate (poly sorbate 85) T-Maz-85; poly ethylene glycol-20-sorbitan-tristearate (poly sorbate 65) T-Maz-65; poly ethylene glycol-20-sorbitan-tritallate T-Maz-95; all being available from PPG-Mazer, division of PPG Chemicals Corporation, (21) poly ethylene glycol-20-sorbitan esters such as poly ethylene glycol-20-sorbitan palmitate (poly sorbate 40) T-Maz-60; poly ethylene glycol-20-sorbitan-tallate T-Maz-90; poly ethylene glycol-20-sorbitan-trioleate (poly sorbate 85) T-Maz-85; poly ethylene glycol-20-sorbitan-tristearate (poly sorbate 65) T-Maz-65; poly ethylene glycol-20-sorbitan-tritallate T-Maz-95; all being available from PPG-Mazer, division of PPG Chemicals Corporation, (22) poly ethylene glycol-40-sorbitan esters such as poly ethylene glycol-40-sorbitan diisostearate Emsorb 2726 available from Henkel/Emery corporation; poly ethylene glycol-40-sorbitan hexoleate Sorbeth 40HO available from Croda Incorporated ; poly ethylene glycol-40-sorbitan peroleate Arlatone T, available from ICI America Corporation; poly ethylene glycol-40-sorbitan tetraoleate Nikkol GO-440, available from Nikko Chemical Company, (23) poly ethylene glycol-60-sorbitan esters such as poly ethylene glycol-60-sorbitan tetraoleate Nikkol GO-460; poly ethylene glycol-60-sorbitan tetrastearate Nikkol GS-460; both being available from, Nikko Chemical Company, (24) polyglyceryl-2-esters such as polyglyceryl-2-borate sesquioleate Emulbon S-83, available from Toho Chemical Company; polyglyceryl-2-tetrastearate Caprol 2G4S available from Capital City Products Company, (25) polyglyceryl-3-esters such as polyglyceryl-3-oleate Grindtek PGE 25; polyglyceryl-3-isostearate Grindtek PGE 55; both being available from Grindsted Products Incorporated; polyglyceryl-3-diisostearate Emerest 2452, available from Henkel Corporation, (26) polyglyceryl-4-esters such as polyglyceryl-4-oleate, Witconol 14, available from Witco Corporation, (27) polyglyceryl-6-esters such as polyglyceryl-6-stearate, Mazol PGS-61, available from PPG-Mazer, division of PPG Chemicals Corporation; polyglyceryl-6-distearate, Polyaldo DGHO, available from Lonza Incorporated, (28) polyglyceryl-8-esters such as polyglyceryl-8-oleate, Santone 8-I-o; polyglyceryl-8-stearate, Santone 8-I-S, both being available from Van Den Burgh Foods Company, (29) polyglyceryl-10-esters such as polyglyceryl-10-laurate, Nikkol Decaglyn I-L; polyglyceryl-10-oleate, Nikkol Decaglyn 1-O; polyglyceryl-10-myristate, Nikkol Decaglyn 1-M; polyglyceryl-10-linoleate, Nikkol Decaglyn I-LN; polyglyceryl-10-stearate Nikkol Decaglyn I-S; polyglyceryl-10-trioleate, Nikkol Decaglyn 3-O; polyglyceryl-10-tristearate, Nikkol Decaglyn 3-S; available from Nikko Chemical Company; polyglyceryl-10-tetracocate, Caplube 8445; polyglyceryl-10-tetraoleate, Caplube 8440, available from Capital City Products Company; polyglyceryl-10-pentaoleate, Nikkol Decaglyn 5-O; polyglyceryl-10-penta stearate, Nikkol Decaglyn 5-S; polyglyceryl-10-pentaisostearate, Nikkol Decaglyn 5-IS; available from Nikko Chemical Company; polyglyceryl-10-hexaoleate Polyaldo DGHO, available from Lonza Incorporated; polyglyceryl-10-heptaoleate, Nikkol Decaglyn 7-; polyglyceryl-10-heptastearate, Nikkol Decaglyn 7-S; polyglyceryl-10-heptaisostearate, Nikkol Decaglyn 7-IS; available from Nikko Chemical Company; polyglyceryl-10-octaoleate, Drewpol 10-8-O, available from Stepan/PVO Company; polyglyceryl-10-decaoleate, Nikkol Decaglyn 10-O; polyglyceryl-10-decastearate, Nikkol Decaglyn 10-S; polyglyceryl-10-decaisostearate, Nikkol Decaglyn 10-IS; all three being available from Nikko Chemical Company; polypropylene glycol esters such as polypropylene glycol-T-oleate where T varies from 2 to 50 such as polypropylene glycol-36-oleate, Witconol F26-46 available from Witco Chemicals; polypropylene glycol-20-methyl glucoside distearate, Glucam P-20 distearate, available from Amerchol Corporation; and mixtures thereof.

Polyethyleneglycol sorbitan esters, Polyethyleneglycol hydantoin esters and Polyethyleneglycol esters derived from flower oils are preferred because these are environmental friendly.

In addition, the coatings 99, 100, 102 and 104 contain antistatic agents. Antistatic components can be present in any effective amount, and if present, typically are present in amounts of from about 0.5 to about 20.0 percent by weight of the coating composition.

Suitable antistatic agents include both anionic and cationic materials.

Monoester sulfosuccinates, diester sulfosuccinates and sulfosuccinamates are anionic antistatic components which have been found suitable for use in the first coating.

Suitable cationic antistatic components comprise diamino alkanes; quaternary salts; quaternary acrylic copolymer latexes HX-42-1, HX-42-3 available from Inter Polymer Corporation; and ammonium quaternary salts as disclosed in U.S. Pat. No. 5,320,902 (Malhotra et al), phosphonium quaternary salts as disclosed in Copending application U.S. Ser. No. 08/034,917 and sulfonium, thiazolium and benzothiazolium quaternary salts as disclosed in U.S. Pat. No. 5,314,747 (Malhotra and Bryant)

In addition, the coatings 99, 104 contain light color filler pigment particles which exhibit a light color. Pigments can be present in any effective amount, and if present, typically are present in amounts of from about 0.1 to about 75 percent by weight of the coating composition. Examples of pigment components include zirconium oxide (SF-EXTRA available from Z-Tech Corporation), colloidal silicas, such as Syloid 74, available from W.R. Grace and Company (preferably present, in one embodiment, in an amount of from about 10 to about 70 percent by weight percent), titanium dioxide (available as Rutile or Anatase from NL Chem Canada, Inc.), hydrated alumina (Hydrad TMC-HBF, Hydrad TM-HBC, available from J.M. Huber Corporation), barium sulfate (K.C. Blanc Fix HD80, available from Kali Chemie Corporation), calcium carbonate (Microwhite Sylacauga Calcium Products), high brightness clays (such as Engelhard Paper Clays), calcium silicate (available from J.M. Huber Corporation), cellulosic materials insoluble in water or any organic solvents (such as those available from Scientific Polymer Products), blend of calcium fluoride and silica, such as Opalex-C available from Kemira, O.Y., zinc oxide, such as Zoco Fax 183, available from Zo Chem, blends of zinc sulfide with barium sulfate, such as Lithopane, available from Schteben Company, and the like, as well as mixtures thereof. Brightener pigments can enhance color mixing and assist in improving print-through in recording sheets of the present invention.

The polymers of the third coating 104 composition include previously mentioned polyesters as well as some other hydrophobic polymers selected from the group consisting of: poly (vinyl formal), such as #012, available from Scientific Polymer Products, poly (vinyl butyral), such as #043, #511, #507, available from Scientific Polymer Products, polyvinyl acetate, #346 available from Scientific Polymer Products, vinyl alcohol-vinyl butyral copolymers such as #381, available from Scientific Polymer Products, vinyl alcohol-vinyl acetate copolymers such as #379, available from Scientific Polymer Products, vinyl chloride-vinyl acetate copolymers such as #063, #068, #070, #422 available from Scientific Polymer Products, vinyl chloride-vinyl acetate-vinyl alcohol terpolymers such as #064, #427, #428 available from Scientific Polymer Products, vinyl chloride-vinylidene chloride copolymers such as #058, available from Scientific Polymer Products, vinylidene chloride-acrylonitrile copolymers such as #395, #396, available from Scientific Polymer products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, cellulose acetate butyrate, such as #077, available from Scientific Polymer Products, cellulose propionate such as #2052, available from Scientific Polymer Products, polystyrene such as #039A, #039D, #845, #756 available from Scientific Polymer Products, poly (4-methylstyrene), such as #315, #593, #839, available from Scientific Polymer Products, poly (α-methylstyrene), such as #2055, available from Scientific Polymer Products, poly (tert-butylstyrene), such as #177, available from Scientific Polymer Products, poly (2-chlorostyrene), such as #777, available from Scientific Polymer Products, poly (3-chlorostyrene), such as #778, available from Scientific Polymer Products, poly (4-chlorostyrene), such as #257, available from Scientific Polymer Products, poly (2-bromostyrene), such as #775, available from Scientific Polymer Products, poly (3-bromostyrene), such as #776, available from Scientific Polymer Products, poly (4-bromostyrene), such as #212, available from Scientific Polymer Products, poly (4-methoxy styrene), such as #314, available from Scientific Polymer Products, poly (2,4,6-tribromostyrene), such as #166, available from Scientific Polymer Products, styrene-butylmethacrylate copolymers, such as #595, available from Scientific Polymer Products, styrene-acrylonitrile copolymers, such as #495, available from Scientific Polymer Products, styrene-allyl alcohol copolymers, such as #393, #394 available from Scientific Polymer Products, poly(2-vinyl pyridine) such as #813, #814 available from Scientific Polymer Products, poly(4-vinyl pyridine) such as #700, #840 available from Scientific Polymer Products, poly(2-vinyl pyridine-co-styrene) such as #319, available from Scientific Polymer Products, poly(4-vinyl pyridine-co-styrene) such as #416, #859 available from Scientific Polymer Products, poly(4-vinyl pyridine-co-butylmethacrylate) such as #312, #667, #858, available from Scientific Polymer Products, poly(vinyl toluene) such as #261, available from Scientific Polymer Products, poly(2-vinyl naphthalene) such as #163, available from Scientific Polymer Products, poly(methylmethacrylate) such as #037A, #037B, #037D, #307, #424, #689, available from Scientific Polymer Products, poly(ethyl methacrylate) such as #113, #308, available from Scientific Polymer Products, poly(isopropyl methacrylate) such as #476, available from Scientific Polymer Products, poly(phenyl methacrylate) such as #227, available from Scientific Polymer Products, poly(phenoxy ethyl methacrylate) such as #893, available from Scientific Polymer Products, poly(2-hydroxypropyl methacrylate) such as #232, available from Scientific Polymer Products, polyamide resin such as #385, #386, #387, #388, #389, #390, available from Scientific Polymer Products, poly (p-phenylene ether-sulfone) (such as #392, available from Scientific Polymer Products), polysulfones, such as #046, available from Scientific Polymer Products, aromatic ester carbonate copolymers, such as APE KLI-9306, APE KLI-9310, available from Dow Chemical Company, poly carbonates, such as #035, available from Scientific Polymer Products, α-methylstyrene-dimethylsiloxane block copolymers, such as PS 0965, available from Petrarch Systems, dimethyl siloxane-bisphenol A carbonate block copolymers, such as PSO99, available from Petrarch Systems, poly (2,6-dimethyl p-phenylene oxide), such as #126, available from Scientific Polymer Products.

In a preferred embodiment the third coating 104 is comprised of from about 89 percent by weight to about 40 percent by weight of the binder or mixture thereof, from about 0.5 percent by weight to about 20 percent by weight of the antistatic agent or mixture thereof, from about 0.5 percent by weight to about 20 percent by weight of the lightfastness inducing agent or mixture thereof, and from about 10 percent by weight to about 20 percent by weight of the filler or mixture thereof.

The coating compositions discussed above can be applied to the substrate by any suitable technique. For example, the coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in the contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25° to about 100° C. in an air drier.

Laminated imaged substrates of the present invention exhibit reduced curl upon being printed with dry toners/aqueous inks. Generally, the term "curl" refers to the distance between the base line of the arc formed by the imaged substrate when viewed in cross-section across its width (or shorter dimension—for example, 8.5 inches in an 8.5 by 11 inch sheet, as opposed to length, or longer dimension—for example, 11 inches in an 8.5 by 11 inch sheet) and the midpoint of the arc. To measure curl, a sheet can be held with the thumb and forefinger in the middle of one of the long edges of the sheet (for example, in the middle of one of the 11 inch edges in an 8.5 by 11 inch sheet) and the arc formed by the sheet can be matched against a pre-drawn standard template curve.

The gloss values recited herein were obtained on a 75° Glossmeter, Glossgard II from Pacific Scientific (Gardner/Neotec Instrument Division).

The optical density measurements recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of the xerographic transparency imaging substrate containing toner receiving coating 99 and abrasion resistant coating 104

Twenty coated imaging substrates were prepared by the solvent extrusion process on a Faustel Coater using a one slot die, by providing for each a transparent Mylar® base (roll form) with a thickness of 100 microns and coating the base with a toner receiving composition comprised of 90 percent by weight of polyester latex Eastman AQ 29D available from Eastman Chemical Company, 2.0 percent by weight of the antistatic agent commercially available from Alkaril Chemicals as, Alkasurf SS-L7DE, 2 percent by weight of UV absorbing compound 2-(4-benzoyl-3-hydroxyphenoxy)ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), 3.0 percent by weight of microspheres Miralite 177 (vinylidene chloride-acrylonitrile, available from Pierce & Stevens Chemical Corp.); 1.0 percent by weight of non-ionic biocide, such as 2-hydroxypropylmethane thiosulfonate (Busan 1005, available from Buckman Laboratories Inc.) which composition was present in a concentration of 10 percent by weight in water. Subsequent to air drying at 100° C. and monitoring the difference in weight prior to and subsequent to coating, the dried transparent Mylar® base rolls contained 1 gram, 10 microns in thickness, of polyester toner receiving layer. Rewinding the coated side of the transparent Mylar® on to an empty core and using these rolls, the uncoated sides of the Mylar® were coated in each instance (20 sheets) with a hydrophobic blend comprised of 90 percent by weight of hydroxypropylmethyl cellulose phthalate, HPMCP, available from Shin-Etsu Chemical; 5 percent by weight of the antistat polymethyl acrylate trimethyl ammonium chloride latex, HX42-1, available from Interpolymer Corp; 3 percent by weight of UV absorbing compound 2-(4-benzoyl-3-hydroxyphenoxy) ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), present in a concentration of 5 percent by weight in acetone. Subsequent to air drying at 100° C. and monitoring the difference in weight prior to and subsequent to coating, the dried Mylar® rolls contained 0.5 gram, 5 microns in thickness, of the scuff resistant, lightfast, waterfast and high gloss coating of hydroxypropylmethyl cellulose phthalate containing polymethyl acrylate trimethyl ammonium chloride latex, 2-(4-benzoyl-3-hydroxyphenoxy) ethylacrylate and didodecyl-3,3'-thiodipropionate. The coated imaging substrates were cut from this roll into 8.5 by 11.0 inch cut sheet. These substrates or sheets were utilized in a Xerox 5760 MajestiK™ Digital Color Copier using polyester resin based toners and images were obtained on the toner receiving side of the imaging substrate. These images had optical density values of 1.37 (cyan), 1.23 (magenta), 0.87 (yellow) and 1.54 (black). These images were waterfast when washed with water for 2 minutes at 50° C. and lightfast for a period of three months without any change in their optical density.

Preparation of the coating 104 on the backside of the backing substrate

Twenty coated backing substrates were prepared by the solvent extrusion process (single side each time initially) on a Faustel Coater using a one slot die, by providing for each opaque polyester Melinex®, (roll form) with a thickness of 75 microns with a coating 104 which is resistant to scuffing from a hydrophobic blend comprised of 65 percent by weight of hydroxypropylmethyl cellulose phthalate, HPMCP, available from Shin-Etsu Chemical, 5 percent by weight of the antistat polymethyl acrylate trimethyl ammonium chloride latex, such as HX42-1, available from Interpolymer Corp, 3 percent by weight of UV absorbing compound 2-(4-benzoyl-3-hydroxyphenoxy)ethylacrylate (Cyasorb UV-416, #41,321-6, available from Aldrich chemical company), 2 percent by weight of an antioxidant compound didodecyl-3,3'-thiodipropionate (Cyanox, LTDP, #D12,840-6, available from Aldrich chemical company) and 25 percent by weight of colloidal silica, Syloid 74, available from W.R. Grace Company, which blend was present in a concentration of 5 percent by weight in acetone. Subsequent to air drying at 100° C. and monitoring the difference in weight prior to and subsequent to coating, the dried opaque polyester Melinex®, rolls contained 0.5 gram, 5 microns in thickness, of the scuff resistant, lightfast, waterfast and high gloss coating of hydroxypropylmethyl cellulose phthalate containing polymethyl acrylate trimethyl ammonium chloride latex, 2-(4-benzoyl-3-hydroxyphenoxy) ethylacrylate, didodecyl 3,3'-thiodipropionate and colloidal silica.

Preparation of two layered adhesive coating 100/102 for adhering backing substrates to imaged transparent substrates Rewinding the opaque polyester Melinex®, (roll form) containing coating 104 on to an empty core and using these rolls, the uncoated sides of the opaque polyester Melinex®, were coated with a heat and pressure sensitive coating combination 100/102. This two layered 100/102 coating structure was prepared by the solvent extrusion process on a Faustel Coater using a two slot die, by providing for each an opaque polyester Melinex®, base (roll form) with a thickness of 75 microns and coating the base simultaneously with two polymeric layers where the first layer 100 in contact with the substrate was comprised of a blend of 90 percent by weight Resapol HT linear polyester, available from Rezana Brazil, 5.0 percent by weight of the antistatic agent Alkasurf SS-0-75, available from Alkaril Chemicals, 3.0 percent by weight of the UV absorbing compound poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company) and 2 percent by weight of an antioxidant compound 2,6-ditert-butyl-4-(dimethylaminomethyl)phenol (Ethanox 703, #41,327-5, available from Aldrich chemical company), which composition was present in a concentration of 10 percent by weight in toluene and the second layer 102 in contact with the first layer was a polymer having excellent image-wetting properties such as poly ethylene glycol-60-sorbitan esters such as poly ethylene glycol-60-sorbitan tetraoleate Nikkol GO-460; available from Nikko Chemical Company, present in a concentration of 20 percent by weight in toluene. Subsequent to air drying the two layers simultaneously at 100° C. and monitoring the difference in weight prior to and subsequent to coating, the dried opaque polyester Melinex® rolls contained 1.5 gram, 15 microns in thickness of the polyester adhesive overcoated with poly ethylene glycol-60-sorbitan tetraoleate. The opaque polyester Melinex®, coated backing substrates were cut from this roll in sizes of 8.5 by 11.0 inch cut sheets.

Lamination of imaged transparency containing coating 99 with the coated backing substrate containing coating 100/102

The imaged side of the transparency was brought in contact with the heat and pressure sensitive material coated side of the coated backing substrate and laminated at 150° C. and a pressure of 100 psi for 2 minutes in a Model 7000 Laminator from Southwest Binding Systems, Ontario, Canada. The laminated structure of opaque polyester Melinex®, and transparent Mylar® containing polyester images were not grainy, had a curl value of 10 mm compared to curl values of laminated structures without using all polyester materials which are in the range between 50–75 mm; had no defects (no air pockets); and had a gloss of 130 units, and optical density values of 1.37 (cyan), 1.23 (magenta), 0.87 (yellow) and 1.54 (black). These images were waterfast when washed with water for 2 minutes at 50° C. and lightfast for a period of three months without any change in their optical density. The back side of the laminated substrates were nonslippery, robust without any finger print marks and could be written upon by pen and pencil.

EXAMPLE II

Preparation of the xerographic transparency containing toner receiving coating 99 and abrasion resistant coating 104

Twenty coated imaging substrates were prepared by the solvent extrusion process (single side each time initially) on a Faustel Coater using a one slot die, by providing for each a transparent Mylar® base (roll form) with a thickness of 100 microns and coating the base with a toner receiving composition comprised of 90 percent by weight crosslinked Resapol HT, with a degree of cross-linking 10 percent, obtained via reactive extrusion process as described in U.S. Pat. No. 5,227,460; 2.0 percent by weight of the antistatic agent commercially available from Alkaril Chemicals as, Alkasurf SS-L7DE, 2 percent by weight of UV absorbing compound 2-(4-benzoyl-3-hydroxyphenoxy)ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), 3.0 percent by weight of microspheres Miralite 177 (vinylidene chloride-acrylonitrile, available from Pierce & Stevens Chemical Corp.); 1.0 percent by weight of non-ionic biocide, such as 2-hydroxypropylmethane thiosulfonate (Busan 1005, available from Buckman Laboratories Inc.) which composition was present in a concentration of 10 percent by weight in toluene. Subsequent to air drying at 100° C. and monitoring the difference in weight prior to and subsequent to coating, the dried Mylar® base rolls contained 1 gram, 10 microns in thickness, of polyester toner receiving layer. Rewinding the coated side of Mylar® on to an empty core and using these rolls, the uncoated sides of Mylar® were coated in each instance (20 sheets) with a hydrophobic blend comprised of 90 percent by weight of hydroxypropyl methyl cellulose succinate, HPMCS, available from Shin-Etsu Chemical; 5 percent by weight of the antistat polymethyl acrylate trimethyl ammonium chloride latex, such as HX42-1, available from Interpolymer Corp; 3 percent by weight of UV absorbing compound 2-(4-benzoyl-3-hydroxyphenoxy)ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), present in a concentration of 5 percent by weight in acetone. Subsequent to air drying at 100° C. and monitoring the difference in weight prior to and subsequent to coating, the dried transparent Mylar® rolls contained 0.5 gram, 5 microns in thickness, of the scuff resistant, lightfast, waterfast and high gloss coating of hydroxypropylmethyl cellulose phthalate containing polymethyl acrylate trimethyl ammonium chloride latex, 2-(4-benzoyl-3-hydroxyphenoxy)ethylacrylate and didodecyl-3,3'-thiodipropionate. The coated imaging substrates [transparencies] were cut from this roll into 8.5 by 11.0 inch cut sheets. These transparencies were utilized in a Xerox 5760 MajestiK™ Digital Color Copier carrying polyester resin based toners and images were obtained on the toner receiving side of the imaging substrate [transparency]. These images had optical density values of 1.45 (cyan), 1.28 (magenta), 0.89 (yellow) and 1.50 (black). These images were waterfast when washed with water for 2 minutes at 50° C. and lightfast for a period of three months without any change in their optical density.

Preparation of the coating 104 on the back side of the backing substrate

Twenty coated backing substrates were prepared by the solvent extrusion process (single side each time initially) on a Faustel Coater using a one slot die, by providing for each opaque polyester Melinex® (roll form) with a thickness of 75 microns with a coating 104 which is resistant to scuffing from a hydrophobic blend comprised of 65 percent by weight of hydroxypropyl methyl cellulose succinate, HPMCS, available from Shin-Etsu Chemical, 5 percent by weight of the antistat polymethyl acrylate trimethyl ammonium chloride latex, HX42-1, available from Interpolymer Corp, 3 percent by weight of UV absorbing compound 2-(4-benzoyl-3-hydroxyphenoxy)ethylacrylate (Cyasorb UV-416, #41,321-6, available from Aldrich chemical company), 2 percent by weight of an antioxidant compound didodecyl-3,3'-thiodipropionate (Cyanox, LTDP, #D12,840-6, available from Aldrich chemical company) and 25 percent by weight of colloidal silica, Syloid 74, available from Grace Company, which blend was present in a concentration of 5 percent by weight in acetone. Subsequent to air drying at 100° C. and monitoring the difference in weight prior to and subsequent to coating, the dried opaque polyester Melinex®, rolls contained 0.5 gram, 5 microns in thickness of the scuff resistant, lightfast, waterfast and high gloss coating of hydroxypropylmethyl cellulose succinate, containing polymethyl acrylate trimethyl ammonium chloride, 2-(4-benzoyl-3-hydroxyphenoxy)ethylacrylate, didodecyl-3,3'-thiodipropionate and colloidal silica.

Preparation of two layered adhesive coating 100/102 for adhering backing substrates to imaged transparent substrates Rewinding the opaque polyester Melinex®, (roll form) containing coating 104 on to an empty core and using these rolls, the uncoated sides of the opaque polyester Melinex®, were coated with a heat and pressure sensitive coating combination 100/102. This two layered 100/102 coating structure was prepared by the solvent extrusion process on a Faustel Coater using a two slot die, by providing for each an opaque polyester Melinex®, (roll form) with a thickness of 75 microns and coating the base simultaneously with two polymeric layers where the first layer 100 in contact with the substrate was comprised of a blend of 70 percent by weight crosslinked Resapol HT, with a degree of cross-linking 10 percent, obtained via reactive extrusion process as described in U.S. Pat. No. 5,227,460; 20 percent by weight 1,4-cyclohexane dimethanol dibenzoate, Benzoflex 352; available from Velsicol Chemical Company, 5.0 percent by weight of the antistatic agent Alkasurf SS-0-75, available from Alkaril Chemicals, 3.0 percent by weight of the UV absorbing compound poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company) and 2 percent by weight of an antioxidant compound 2,6-ditert-butyl-4-(dimethylaminomethyl)phenol (Ethanox 703, #41,327-5, available from Aldrich chemical company), which composition was present in a concentration of 10 percent by weight in toluene and the second layer 102 in contact with the first layer 100 was a polymer having excellent image-wetting properties such as polyethyleneglycol-15-di-(2-hydroxyethyl)-5,5-dimethylhydantoin oleate, Dantosperse DHE (15) MO; available from Lonza Incorporated, present in a concentration of 20 percent by weight in toluene. Subsequent to air drying the two layers simultaneously at 100° C. and monitoring the difference in weight prior to and subsequent to coating, the dried opaque polyester Melinex® rolls contained 1.5 gram, 15 microns in thickness, of the polyester adhesive overcoated with polyethyleneglycol-15-di-(2-hydroxyethyl)-5,5-dimethylhydantoinoleate, Dantosperse DHE (15) MO; available from Lonza Incorporated. The opaque polyester Melinex®, coated backing substrate were cut from this roll in sizes of 8.5 by 11.0 inch cut sheets.

Lamination of imaged transparency containing coating 99 with the coated backing substrate containing coating 100/102

The imaged side of the transparency was brought in contact with the heat and pressure sensitive material coated side of the coated backing substrate and laminated at 150° C. and a pressure of 100 psi for 2 minutes in a Model 7000 Laminator from Southwest Binding Systems, Ontario, Canada. The laminated structure of opaque polyester Melinex®, and transparent Mylar® containing polyester images were not grainy, had a curl value of 10 mm compared to curl values of laminated structures created without using all polyester materials which are in the range between 50–75 mm; had no defects (no air pockets); had a gloss of 130 units, and optical density values of 1.37 (cyan), 1.23 (magenta), 0.87 (yellow) and 1.54 (black). These images were waterfast when washed with water for 2 minutes at 50° C. and lightfast for a period of three months without any change in their optical density The back side of the laminated substrate were non-slippery, robust without any finger print marks and could be written upon by pen and pencil.

EXAMPLE III

Preparation of the xerographic Transparency containing toner receiving coating 99 and abrasion resistant coating 104

Twenty coated imaging substrates were prepared by the solvent extrusion process (single side each time initially) on a Faustel Coater using a one slot die, by providing for each a transparent Mylar® base (roll form) with a thickness of 100 microns and coating the base with a toner receiving composition comprised of 90 percent by weight crosslinked Resapol HT, with a degree of cross-linking 30 percent, obtained via reactive extrusion process as described in U.S. Pat. No. 5,227,460; 2.0 percent by weight of the antistatic agent commercially available from Alkaril Chemicals as, Alkasurf SS-L7DE, 2 percent by weight of UV absorbing compound 2-(4-benzoyl-3-hydroxyphenoxy)ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), 3.0 percent by weight of microspheres Miralite 177 (vinylidene chloride-acrylonitrile, available from Pierce & Stevens Chemical Corp.); 1.0 percent by weight of non-ionic biocide, such as 2-hydroxypropylmethane thiosulfonate (Busan 1005, available from Buckman Laboratories Inc.) which composition was present in a concentration of 10 percent by weight in toluene. Subsequent to air drying at 100° C. and monitoring the difference in weight prior to and subsequent to coating, the dried transparent Mylar® base rolls contained 1 gram, 10 microns in thickness, of polyester toner receiving layer. Rewinding the coated side of the transparent Mylar® on to an empty core and using these rolls, the uncoated side of the transparent Mylar® were coated in each instance (20 sheets) with a hydrophobic blend comprised of 90 percent by weight of hydroxypropyl methyl cellulose succinate, HPMCS, available from Shin-Etsu Chemical; 5 percent by weight of the antistat polymethyl acrylate trimethyl ammonium chloride latex, HX42-1, available from Interpolymer Corp; 3 percent by weight of UV absorbing compound 2-(4benzoyl-3-hydroxyphenoxy) ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), present in a concentration of 5 percent by weight in acetone. Subsequent to air drying at 100° C. and monitoring the difference in weight prior to and subsequent to coating, the dried transparent Mylar® rolls contained 0.5 gram, 5 microns in thickness, of the scuff resistant, lightfast, waterfast and high gloss coating of hydroxypropylmethyl cellulose phthalate containing polymethyl acrylate trimethyl ammonium chloride latex, 2-(4-benzoyl-3-hydroxyphenoxy)ethylacrylate and didodecyl 3,3'-thiodipropionate. The coated imaging substrates were cut from this roll into 8.5 by 11.0 inch cut sheets. These imaging substrates were utilized in a Xerox 5760 MajestiK™ Digital Color Copier carrying polyester resin based toners and images were obtained on the toner receiving side of the imaging substrate. These images had optical density values of 1.35 (cyan), 1.18 (magenta), 0.83 (yellow) and 1.53 (black). These images were waterfast when washed with water for 2 minutes at 50° C. and lightfast for a period of three months without any change in their optical density.

Preparation of the coating 104 on the back side of the backing substrate

Twenty coated backing substrates were prepared by the solvent extrusion process (single side each time initially) on a Faustel Coater using a one slot die, by providing for each opaque polyester Melinex®, (roll form) with a thickness of 75 microns with a coating 104 which is resistant to scuffing from a hydrophobic blend comprised of 65 percent by weight of hydroxypropyl methyl cellulose succinate, such as HPMCS, available from Shin-Etsu Chemical, 5 percent by weight of the antistat polymethyl acrylate trimethyl ammonium chloride latex, HX42-1, available from Interpolymer Corp, 3 percent by weight of UV absorbing compound 2-(4-benzoyl-3-hydroxyphenoxy)ethylacrylate (Cyasorb UV-416, #41,321-6, available from Aldrich chemical company), 2 percent by weight of an antioxidant compound didodecyl-3,3'-thiodipropionate (Cyanox, LTDP, #D12,840-6, available from Aldrich chemical company) and 25 percent by weight of colloidal silica, Syloid 74, available from Grace Company, which blend was present in a concentration of 5 percent by weight in acetone. Subsequent to air drying at 100° C. and monitoring the difference in weight prior to and subsequent to coating, the dried opaque polyester Melinex® rolls contained 0.5 gram, 5 microns in thickness of the scuff resistant, lightfast, waterfast and high gloss coating of hydroxypropylmethyl cellulose succinate, containing polymethyl acrylate trimethyl ammonium chloride latex, 2-(4-benzoyl-3-hydroxyphenoxy) ethylacrylate, didodecyl-3,3'-thiodipropionate and colloidal silica.

Preparation of two layered adhesive coating 100/102 for adhering backing substrates to imaged transparent substrates Rewinding the opaque polyester Melinex®, (roll form) containing coating 104 on to an empty core and using these rolls, the uncoated side of the opaque polyester Melinex®, were coated with a heat and pressure sensitive coating combination 100/102. This two layered 100/102 coating structure was prepared by the solvent extrusion process on a Faustel Coater using a two slot die, by providing for each an opaque polyester Melinex®, base(roll form) with a thickness of 75 microns and coating the base simultaneously with two polymeric layers where the first layer 100 in contact with the substrate was comprised of a blend of 70 percent by weight crosslinked Resapol HT, with a degree of cross-linking 30 percent, obtained via reactive extrusion process as described in U.S. Pat. No. 5,227,460; 20 percent by weight sucrose stearate, Ryoto Sugar Ester S-1570, available from Ryoto Company, 5.0 percent by weight of the antistatic agent Alkasurf SS-0-75, available from Alkaril Chemicals, 3.0 percent by weight of the UV absorbing compound poly[N,N-bis(2,2,6,6-tetramethyl-4-piperidinyl)-1,6-hexanediamine-co-2,4-dichloro-6morpholino-1,3,5-triazine) (Cyasorb UV-3346, #41,324-0, available from Aldrich chemical company) and 2 percent by weight of an antioxidant compound 2,6-ditert-butyl-4-(dimethylaminomethyl)phenol (Ethanox 703, #41,327-5, available from Aldrich chemical company), which composition was present in a concentration of 10 percent by weight in toluene and the second layer 102 in contact with the first layer 100 was a polymer having excellent image-wetting properties such as polyglyceryl-2-borate sesquioleate Emulbon S-83, available from Toho Chemical Company, present in a concentration of 20 percent by weight in toluene. Subsequent to air drying the two layers simultaneously at 100° C. and monitoring the difference in weight prior to and subsequent to coating, the dried opaque polyester Melinex® rolls contained 1.5 gram, 15 microns in thickness, of the polyester adhesive overcoated with polyglyceryl-2-borate sesquioleate, Emulbon S-83, available from Toho Chemical Company. The opaque polyester Melinex®, coated backing substrates were cut from this roll in sizes of 8.5 by 11.0 inch cut sheets.

Lamination of imaged transparency containing coating 99 with the coated backing substrate containing coating 100/102

The imaged side of the transparency was brought in contact with the heat and pressure sensitive material coated side of the coated backing substrate and laminated at 150° C. and a pressure of 100 psi for 2 minutes in a Model 7000 Laminator from Southwest Binding Systems, Ontario, Canada. The laminated structure of opaque polyester Melinex®, and transparent Mylar® containing polyester images were not grainy, had a curl value of 10 mm compared to curl values of laminated structures without using all polyester materials which are in the range between 50–75 mm; had no defects (no air pockets); had a gloss of 130 units, and had optical density values of 1.35 (cyan), 1.18 (magenta), 0.83 (yellow) and 1.53 (black). These images were waterfast when washed with water for 2 minutes at 50° C. and lightfast for a period of three months without any change in their optical density. The back side of the laminated substrates were non-slippery, robust without any finger print marks and could be written upon by pen and pencil.

EXAMPLE IV

Preparation of the xerographic Transparency containing toner receiving coating 99 and abrasion resistant coating 104

Twenty coated imaging substrates were prepared by the solvent extrusion process (single side each time initially) on a Faustel Coater using a one slot die, by providing for each a transparent Mylar® base (roll form) with a thickness of 100 microns and coating the base with a toner receiving composition comprised of 90 percent by weight crosslinked Resapol HT, with a degree of cross-linking 30 percent, obtained via reactive extrusion process as described in U.S. Pat. No. 5,227,460; 2.0 percent by weight of the antistatic agent commercially available from Alkaril Chemicals as, Alkasurf SS-L7DE, 2 percent by weight of UV absorbing compound 2-(4-benzoyl-3-hydroxyphenoxy)ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), 3.0 percent by weight of microspheres Miralite 177 (vinylidene chloride-acrylonitrile, available from Pierce & Stevens Chemical Corp.); 1.0 percent by weight of non-ionic biocide, such as 2-hydroxypropylmethane thiosulfonate (Busan 1005, available from Buckman Laboratories Inc.) which composition was present in a concentration of 10 percent by weight in toluene. Subsequent to air drying at 100° C. and monitoring the difference in weight prior to and subsequent to coating, the dried transparent Mylar® base rolls contained 1 gram, 10 microns in thickness, of polyester toner receiving layer. Rewinding the coated side of the transparent Mylar® on to an empty core and using these rolls, the uncoated side of the transparent Mylar® were coated in each instance (20 sheets) with a hydrophobic blend comprised of 90 percent by weight of hydroxypropyl methyl cellulose succinate, HPMCS, available from Shin-Etsu Chemical; 5 percent by weight of the antistat polymethyl acrylate trimethyl ammonium chloride latex, HX42-1, available from Interpolymer Corp; 3 percent by weight of UV absorbing compound 2-(4-benzoyl-3-hydroxyphenoxy) ethylacrylate (Cyasorb UV-416, #41,321-6, available from Aldrich chemical company) and 2 percent by weight of an antioxidant compound didodecyl-3,3'-thiodipropionate (Cyanox, LTDP, #D12,840-6, available from Aldrich chemical company), present in a concentration of 5 percent by weight in acetone. Subsequent to air drying at 100° C. and monitoring the difference in weight prior to and subsequent to coating, the dried transparent Mylar® rolls contained 0.5 gram, 5 microns in thickness, of the scuff resistant, lightfast, waterfast and high gloss coating of hydroxypropylmethyl cellulose phthalate containing polymethyl acrylate trimethyl ammonium chloride latex, 2-(4-benzoyl-3-hydroxyphenoxy)ethylacrylate and didodecyl-3,3'-thiodipropionate. The coated imaging substrates were cut from this roll into 8.5 by 11.0 inch cut sheets. These imaging substrates were utilized in a Xerox 5760 MajestiK™ Digital Color Copier carrying polyester resin based toners and images were obtained on the toner receiving side of the imaging substrate. These images had optical density values of 1.35 (cyan), 1.18 (magenta), 0.83 (yellow) and 1.53 (black). These images were waterfast when washed with water for 2 minutes at 50° C. and lightfast for a period of three months without any change in their optical density.

Preparation of the coating 104 on the back side of the backing substrate

Twenty coated backing substrates were prepared by the solvent extrusion process (single side each time initially) on a Faustel Coater using a one slot die, by providing for each opaque polyester Melinex®, sheets (roll form) with a thickness of 75 microns with a coating 104 which is resistant to scuffing from a hydrophobic blend comprised of 65 percent by weight of hydroxypropyl methyl cellulose succinate, HPMCS, available from Shin-Etsu Chemical, 5 percent by weight of the antistat polymethyl acrylate trimethyl ammonium chloride latex, HX42-1, available from Interpolymer Corp, 3 percent by weight of UV absorbing compound 2-(4-benzoyl-3-hydroxyphenoxy)ethylacrylate (Cyasorb UV-416, #41,321-6, available from Aldrich chemical company), 2 percent by weight of an antioxidant compound didodecyl-3,3'-thiodipropionate (Cyanox, LTDP, #D12,840-6, available from Aldrich chemical company) and 25 percent by weight of colloidal silica, such as Syloid 74, available from Grace Company, which blend was present in a concentration of 5 percent by weight in acetone. Subsequent to air drying at 100° C. and monitoring the difference in weight prior to and subsequent to coating, the dried opaque polyester Melinex®, rolls contained 0.5 gram, 5 microns in thickness of the scuff resistant, lightfast, waterfast and high gloss coating of hydroxypropylmethyl cellulose succinate, containing polymethyl acrylate trimethyl ammonium chloride latex, 2-(4-benzoyl-3-hydroxyphenoxy) ethylacrylate, didodecyl-3,3'-thiodipropionate and colloidal silica.

Preparation of two layered adhesive coating 100/102 for adhering backing substrates to imaged transparent substrates Rewinding the opaque polyester Melinex®, (roll form) containing coating 104 on to an empty core and using these rolls, the uncoated sides of the opaque polyester Melinex®, were coated with a heat and pressure sensitive coating combination 100/102. This two layered 100/102 coating structure was prepared by the solvent extrusion process (single side each time initially) on a Faustel Coater using a two slot die, by providing for each an opaque polyester Melinex®, base sheet (roll form) with a thickness of 75 microns and coating the base simultaneously with two polymeric layers where the first layer 100 in contact with the substrate was comprised of 70 percent by weight Vitel polyester #5833 obtained from Shell Chemical Company, 20 percent by weight sucrose stearate, Ryoto Sugar Ester S-1570, available from Ryoto Company, 5.0 percent by weight of the antistatic agent Alkasurf SS-0-75, available from Alkaril Chemicals, 3.0 percent by weight of the UV absorbing compound poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company) and 2 percent by weight of an antioxidant compound 2,6-ditert-butyl-4-(dimethylaminomethyl)phenol (Ethanox 703, #41,327-5, available from Aldrich chemical company), which composition was present in a concentration of 10 percent by weight in toluene and the second layer in contact with the first layer was a polymer having excellent image-wetting properties such as polyglyceryl-2-borate sesquioleate Emulbon S-83, available from Toho Chemical Company, present in a concentration of 20 percent by weight in toluene. Subsequent to air drying the two layers simultaneously at 100° C. and monitoring the difference in weight prior to and subsequent to coating, the dried opaque polyester Melinex® rolls contained 1.5 gram, 15 microns in thickness, of the polyester adhesive overcoated with polyglyceryl-2-borate sesquioleate, Emulbon S-83, available from Toho Chemical Company poly. The opaque polyester Melinex®, coated backing substrates were cut from this roll in sizes of 8.5 by 11.0 inch cut sheets.

Lamination of imaged transparency containing coating 99 with the coated backing substrate containing coating 100/102

The imaged side of the transparency was brought in contact with the heat and pressure sensitive material coated side of the coated backing substrate and laminated at 150° C. and a pressure of 100 psi for 2 minutes in a Model 7000 Laminator from Southwest Binding Systems, Ontario, Canada. The laminated structure of opaque polyester Melinex®, and transparent Mylar® containing polyester images were not grainy, had a curl value of 10 mm compared to curl values of laminated structures without using all polyester materials which are in the range between 50–75 mm; had no defects (no air pockets); had a gloss of 130 units, and had optical density values of 1.35 (cyan), 1.18 (magenta), 0.83 (yellow) and 1.53 (black). These images were waterfast when washed with water for 2 minutes at 50° C. and lightfast for a period of three months without any change in their optical density. The back side of the laminated substrate were non-slippery, robust without any finger print marks and could be written upon by pen and pencil.

Other embodiments and modifications of the present invention may occur to those skilled in the art subsequent to a review of the information presented herein, these embodiments and modifications, as well as equivalents thereof, are also included within the scope of this invention.

What is claimed is:

1. A method of creating simulated photographic-quality prints using non-photographic imaging, said method comprising:

providing a transparent polyester substrate coated with a polyester toner receiving layer on one of its surfaces;

providing a wrong reading polyester toner image formed on said toner receiving layer using a non-photographic imaging process;

providing one surface of a polyester backing substrate with a first coating comprising a polyester adhesive composition having a glass transition temperature of less than 55° C. and comprised of a polyester resin, a low molecular weight adhesion promoting ester compound, an antistatic agent and, a lightfastness inducing agent;

providing said one surface of said backing substrate with a second coating in contact with said first coating wherein said second coating comprises a polyglycol ester compound;

providing a third coating on another surface of said backing substrate which is hydrophobic, antistatic, scuff and abrasion resistant;

laminating said transparent substrate with heat and pressure to said one surface of said backing substrate.

2. The method according to claim 1 wherein said step of providing an imaged transparent substrate comprises providing a substrate containing a wrong reading xerographically formed image.

3. The method according to claim 1 wherein said substrates are selected from the group consisting of (1) polyesters, (2) polyethylene naphthalates, (3) polycarbonates, (4) polysulfones, (5) polyether sulfones, (6) poly (arylene sulfones), (7) cellulose triacetate, (8) polyvinylchloride, (9) cellophane, (10)polyvinyl fluoride, (11) polypropylene, (12) polyimides, (13) Teslin®, (14) Melinex®, (15) Diazo papers, (16) coated photographic papers.

4. The method according to claim 1 wherein said polyester toner receiving layer is comprised of a polyester binder present in an amount of from about 98.5 percent by weight to about 55 percent by weight, a traction agent, present in an amount of from about 0.5 percent by weight to about 5 percent by weight, an antistatic agent present in an amount of from about 0.5 percent by weight to about 20 percent by weight, a lightfastness inducing composition present in an amount of from about 0.5 percent by weight to about 20 percent by weight.

5. The method according to claim 4 wherein said polyester binder comprises a resin selected from the group comprised of (1) polyglycolide, (2) polyglactin, (3) titanium derivatives of polyesters, (4) polyester latex, (5) polyethylene terephthalate resins, (6) polyarylates resins, (7) polybutylene terephthalate based ester resins, (8) unsaturated polyester resins, (9) rosin modified maleic polyester resins, (10) polyester flame retardant, (11) polyester adipate, (12) polyester azelate, (13) polyester glutarate, (14) polyester nylonate, (15) polyester phthalate (16) thiodipropionate polyester, (17) polyester-co-polycarbonate resins, (18) cellulose acetate hydrogen phthalate, (19) hydroxypropylmethyl cellulose phthalate, (20) hydroxypropyl methyl cellulose succinate, (21) cellulose acetate butyrate, (22) cellulose propionate; and mixtures thereof.

6. The method according to claim 4 wherein said polyester toner receiving layer includes a light fastness inducing agent selected from the group consisting of: (1) 2-(4-benzoyl-3-hydroxyphenoxy)ethylacrylate), (2) 1,2-hydroxy-4-(octyloxy)-benzo-phenone, (3) poly|2-(4-benzoyl-3-hydroxyphenoxy)-ethylacrylate|, (4) hexa-decyl-3,5-di-tert-butyl-4-hydroxy-benzoate, (5) poly|N,N-bis(2,2,6,6-tetramethyl-4-piperidinyl)-1,6-hexanediamine-co-2,4-dichloro-6-morpholino-1,3,5-triazine), (6) 2-dodecyl-N-(2,2,6,6-tetramethyl-4-piperidinyl)-succinimide, (7) 2-dodecyl-N-(1,2,2,6,6-pentamethyl-4-piperidinyl) succinimide, (8) N-(1-acetyl-2,2,6,6-tetramethyl-4-piperidinyl)-2-dodecylsuccinimide, (9) 1-|N-|poly(3-allyloxy-2-hydroxypropyl)-2-aminoethyl|-2-imidazolidinone, (10) 2,2'-methylenebis-(6-tert-butyl-4-methylphenol), (11) 2,2'-methylenebis(6-tert-butyl-4-ethylphenol, (12) tris(4-tert-butyl-3-hydroxy-2,6-dimethylbenzyl)isocyanurate, (13) didodecyl-3,3'-thiodipropionate, (14) ditridecyl-3,3'-thiodipropionate, (15) ditetra-decyl-3,3'-thiodipropionate, (16) di-octadecyl-3,3'-thiodipropionate, (17) 1,3,5-trimethyl-2,4,6-tris(3,5-di-tert-butyl-4-hydroxybenzyl) benzene, (18) 2,6-ditert-butyl-4-(dimethylaminomethyl)phenol; and mixtures thereof.

7. The method according to claim 4 wherein said polyester toner receiving layer includes an antistatic agent selected form the group consisting of (1) monoester sulfosuccinates, (2) diester sulfosuccinates, (3) sulfosuccinamates, (4) ammonium quaternary salts, (5) phosphonium quaternary salts, (6) sulfonium quaternary salts, (7) thiazolium quaternary salt, (8) benzothiazolium quaternary salts; and mixtures thereof.

8. The method according to claim 4 wherein said polyester toner receiving layer includes a traction agent selected form the group consisting of (1) zirconium oxide, (2) colloidal silica, (3) titanium dioxide, (4) hydrated alumina, (5) barium sulfate, (6) calcium carbonate, (7) high brightness clays, (8) calcium silicate, (9) cellulosic materials, (10) blend of calcium fluoride and silica, (11) zinc oxide, (12) blends of zinc sulfide with barium sulfate.

9. The method according to claim 4 wherein said thickness of said polyester toner receiving layer is from about 0.1 to about 25 microns.

10. The method according to claim 1 wherein said polyester toner receiving layer is comprised of a polyester resin present in an amount of from about 95 percent by weight to about 10 percent by weight, a low molecular weight adhesion promoting ester compound, present in an amount of from about 4 percent by weight to about 50 percent by weight, an antistatic agent present in an amount of from about 0.5 percent by weight to about 20 percent by weight, a lightfastness inducing composition present in an amount of from about 0.5 percent by weight to about 20 percent by weight.

11. The method according to claim 10 wherein said polyester resin is selected from the group comprised of (1) polyglycolide, (2) polyglactin, (3) titanium derivatives of polyesters, (4) polyester latex, (5) polyethylene terephthalate resins, (6) polyarylates resins, (7) polybutylene terephthalate based ester resins, (8) unsaturated polyester resins, (9) rosin modified maleic polyester resins, (10) polyester flame retardant, (11) polyester adipate, (12) polyester azelate, (13) polyester glutarate, (14) polyester nylonate, (15) polyester phthalate (16) thiodipropionate polyester, (17) polyester-co-polycarbonate resins, (18) cellulose acetate hydrogen phthalate, (19) hydroxypropylmethyl cellulose phthalate, (20) hydroxypropyl methyl cellulose succinate, (21) cellulose acetate butyrate, (22) cellulose propionate; and mixtures thereof.

12. The method according to claim 10 including an adhesion promoting material comprising a low molecular weight ester compounds are selected from the group comprised of (1) monoalkyl esters, (2) dialkyl esters, (3) trialkyl esters, (4) glyceryl esters, (5) glycol esters, (6) pentaerythritol esters and (7) sugar esters.

13. The method according to claim 12 wherein said adhesion promoting low molecular weight monoalkyl ester compounds include: (1) methylricinioleate, (2) methyloctanoate, (3) methyleicosonate, (4) methylsoyate, (5) methyltallowate, (6) methyloleate/linoleate, (7) methylstearate, (8) methylmyristate, (9) methyloleate, (10) methylhydrogenatedrosinate, (11) methyldimerate, (12) ethylpelargonate, (13) isopropylmyristate, (14) isopropylmyristopalmitate, (15) isopropyloleate, (16) isopropyl palmitate, (17) isopropyllanolate, (18) isopropyllinoleate, (19) isopropylisostearate, (20) isobutylpalmitate, (21) isobutyloleate, (22) isobutylstearate, (23) isobutyltallowate, (24) butoxyethyloleate, (25) butylacetylricineolate, (26) butylacetoxystearate, (27) 2-ethylhexyllaurate, (28) 2-ethylhexyloleate, (29) 2-ethylhexyltallowate, (30) tetra-hydrofurfuryloleate, (31) octylpelargonate, (32) octyloxystearate, (33) octylpalmitate, (34) isooctylstearate, (35) isononyloleate, (36) isononylstearate, (37) isononylisononanoate, (38) decylisostearate, (39) decyloleate, (40) isodecylisononanoate, (41) myreth-3-laurate, (42) myreth-3-myristate, (43) myreth-3-palmitate, (44) myristyllactate, (45) myristylmyristate, (46) myristyl-propionate, (47) myristylstearate, (48) myristyleicosylstearate, (49) cetearyllactate, (50) cetearyloctanoate, (51) cetearylpalmitate, (52) cetearyl-isononanoate, (53) cetearylstearate, (54) cetylricinoleate, (55) cetyl-lactate, (56) cetylmyristate, (57) etyloctanoate, (58) cetylpalmitate, (59) cetylstearate, (60) cetylisooctanoate, (61) oleylerucate, (62) oleyloleate, (63) oleyllinoleate, (64) stearylheptanoate, (65) stearoylstearate, (66) isostearylerucate, (67) isostearyl/erucyl-erucate, (68) isostearylisostearate, (69) isostearyineopentanoate, (70) isostearylstearoyl-stearate, (71) octadecylstearate, (72) isooctadecylisononanoate, (73) octadodecanolstearate, (74) octadodecylmyristate, (75) octadodecyloleate, (76) arachidyl-behenate, (77) arachidylpropionate, (78) batylisostearate, (79) behenylerucate, (80) erucyl-erucate, (81) cumyl-phenyl benzoate, (82) cumyl-phenyl neodecaonoate, and mixtures thereof.

14. The method according to claim 12 wherein said adhesion promoting low molecular weight dialkyl ester compounds include (1) dimethyladipate, (2) dimethylsuccinate, (3) dimethylphthalate, (4) dimethylazelate, (5) diallylphthalate, (6) diallylfumarate, (7) diisopropyladipate, (8) diisopropyidimerate, (9) diisopropyl-sebacate, (10) dibutylmaleate, (11) dibutylfumarate, (12) dibutyladipate, (13) dibutyl-sebacate, (14) diisobutyladipate, (15) diisobutylazelate, (16), (17) dibutoxethylazelate, (18) dibutoxyethyladipate, (19) dibutoxyethylphthalate, (20) dibutoxyethylsebacate, (21) dibutoxyethylglutarate, (22) dibutoxyethoxyethyl-glutarate, (23) dibutoxy ethoxyethyladipate, (24) dibutoxyethoxyethylphthalate, (25) dibutoxyethoxyethylsebacate, (26) dibutoxyethoxyethylphthalate, (27) dicyclohexylphthalate, (28) dioctyladipate, (29) dioctylazelate, (30) dioctylsebacate, (31) dioctylfumarate, (32) dioctylmaleate, (33) dioctylterephthalate, (34) dioctyldilinoleate, (35) dioctyldodecanedioatedioleate, (36) octyldodecylstearate, (37) diisooctyladipate, (38) diisooctylmaleate, (39) diisooctyldodecanedioate, (40) diisooctylphthalate, (41) n-octyl,n-decyl,adipate, (42) n-octyl,n-decylphthalate, (43) n-octyln-decyltrimellitate, (44) diisononyladite, (45) diisononylmaleate, (46) diisodecyladipate, (47) diisodecylphthalate, (48) diisodecyinylonate/glutarate, (49) dihydrogenated allowphthalate, (50) dicaprylphthalate, (51) diisocetyladipate, (52) ditridecylmaleate, (53) ditridecylphthalate, (54) diisotridecylphthalate, (55) distearylphthalate, (56) diisostearyl dilinoleate, (57) ditridecyladipate, (58) ditridecyl dilinoleate; and mixtures thereof.

15. The method according to claim 12 wherein said adhesion promoting low molecular weight trialkyl ester compounds include (1) triethanolamine dioleate, (2) trihydroxy methoxy stearin, (3) triisopropyl trilinoleate, (4) tri-n-hexyl trimellitate, (5) trioctyl-trimlitate, (6) octyldodecylstearoylstearate, (7) triisooctyl-trim-ellitate, (8) tridecylneopentanoate, (9) triisocetyl-citrate, (10) triisostearyl-trilinoleate; and mixtures thereof.

16. The method according to claim 12 wherein the adhesion promoting low molecular weight glycol ester compounds include: (1) glycololeate, (2) glycol ricinoleate, (3) glycol tearate, (4) glycol ether glutarate, (5) glycol dilaurate, (6) glycol dioleate, (7) glycol distearate, (8) glycol dibehenate, (9) epoxidized glycol dioleate, (10) propylene glycol laurate, (11) propyleneglycolmyristate, (12) propyleneglycololeate, (13) propyleneglycolstearate, (14) propyleneglycolhydroxystearate, (15) propylene glycol isostearate, (16) propyleneglycol ricinioleate, (17) propylene glycol dibenzoate, (18) propyleneglycol dicaprylate, (19) propyleneglycol dipelargonate, (20) propyleneglycol distearate, (21) 1,4-cyclohexane dimethanol dibenzoate, (22) propyleneglycol dicaprylate/caprate; and mixtures thereof.

17. The method according to claim 12 wherein said adhesion promoting low molecular weight glyceryl ester compounds include: (1) glyceryl caprate, (2) glyceryl caprylate, (3) glyceryl oleate, (4) glyceryl linoleate, (5) glyceryl myristate, (6) glyceryl capromyristate, (7) glyceryl stearate, (8) glyceryl hydroxy stearate, (9) glyceryl isostearate, (10) glyceryl ricinoleate, (11) glyceryl dilaurate, (12) glyceryl dioleate, (13) glyceryldistearate, (14) glycerylmono/dicaprylate, (15) glycerylmono/dimyristate, (16) glycerylstearatepalmitate, (17) glyceryltricaprate/caprylate, (18) caprylic/capricdiglycerylsuccinate, (19) caprylic/capric glycerides, (20) caprylic/capric/isostearic/adipictriglycerides, (21) caprylic/capric/linoleictriglycerides, (22) caprylic/caprictriglycerides, (23) caprylic/capric/stearictriglycerides, (24) glyceryltrilaurate/stearate, (25) glyceryldi/tripalmitostearate, (26) glyceryldi/tritristearate, (27) caprylictriglyceride, (28) caprylic/capric/lauriictriglycerides, (29) glyceryltriheptanoate, (30) glyceryl trioctanoate, (31) glyceryl trilaurate, (32) glyceryl trioleate, (33) glyceryltristearate, (34) glyceryltris-12-hydroxystearate, (35) glyceryltriacetyl hydroxystearate, (36) glyceryl triacetyl ricinioleate, (37) glyceryl triisostearate, (38) glyceryl tribehenate, and mixtures thereof.

18. The method according to claim 12 wherein said adhesion promoting low molecular weight sugar ester compounds include: (1) methylgluceth-20 distearate, (2) methylglucosedioleate, (3) methyl glucose sesquistearate, (4) sucrose cocoate, (5) sucrose oleate, (6) sucrose laurate, (7) sucrose palmitate, (8) sucrose stearate, (9) sucrosemono/distearate, (10) sucrosedistearate, (11) acetylated sucrose distearate, (12) sucrosedi/tristearate, (13) sorbitanlaurate, (14) sorbitanpalmitate, (15) sorbitan myristate, (16) sorbitanoleate, (17) sorbitansesquioleate, (18) sorbitantallate, (19) sorbitansesquitallate, (20) sorbitanstearate, (21) sorbitanisostearate, (22) sorbitan distearate, (23) sorbitan trioleate, (24) sorbitan tritallate, (25) sorbitan tristearate; and mixtures thereof.

19. The method according to claim 12 wherein said adhesion promoting low molecular weight pentaerythritol ester compounds include: (1) pentaerythritol tetrabenzoate, (2) pentaerythritoltetrapelargonate, (3) pentaerythritoltetraoleate, (4) penta erythritolriciniolate, (5) pentaerythritoltetracaprylate/caprate, (6) pentaerythritol-tetra stearate, (7) pentaerythritoltetraisostearate, (8) pentaerythritol-tetra behenate, (9) penta erythritol hydrogenated rosinate (10) pentaerythritol rosinate; and mixtures thereof.

20. The method according to claim 10 wherein said first coating present on said one surface of said polyester backing substrate includes a light fastness inducing agent selected from the group consisting of: (1) 2-(4-benzoyl-3-hydroxyphenoxy)ethylacrylate), (2) 1,2-hydroxy-4-(octyloxy)benzo-phenone, (3) poly[2-(4-benzoyl-3-hydroxyphenoxy) ethylacrylate], (4) hexadecyl-3,5-di-tert-butyl-4-hydroxy-benzoate, (5) poly[N,N-bis(2,2,6,6-tetramethyl-4-piperidinyl)-1,6-hexanediamine-co-2,4-dichloro-6-morpholino-1,3,5-triazine), (6) 2-dodecyl-N-(2,2,6,6-tetramethyl-4-piperidinyl)succinimide, (7) 2-dodecyl-N-(1,2,2,6,6-pentamethyl-4-piperidinyl)succinimide, N-(1-acetyl-2,2,6,6-tetramethyl-4-piperidinyl)-2-dodecylsuccinimide, (8) 1-[N-[poly(3-allyloxy-2-hydroxypropyl)-2-aminoethyl]-2-dinone, (9) poly(2-ethyl-2-oxazoline), (10) 2,2'-methylenebis-(6-tert-butyl-4-methylphenol), (11) 2,2'-methylenebis(6-tert-butyl-4-ethylphenol, (12) tris(4-tert-butyl-3-hydroxy-2,6-dimethylbenzyl)isocyanurate, (13) didodecyl-3,3'-thiodipropionate, (14) ditridecyl-3,3'-thiodipropionate, (15) ditetradecyl-3,3'-thiodipropionate, (16) di-octadecyl-3,3'-thiodipropionate, (17) 1,3,5-trimethyl-2,4,6-tris(3,5-di-tert-butyl-4-hydroxybenzyl) benzene, (18) 2,6-ditert-butyl-4-(dimethylaminomethyl)phenol; and mixtures thereof.

21. The method according to claim 10 wherein said first coating present on said one surface of said polyester backing substrate includes an antistatic agent selected form the group consisting of (1) monoester sulfosuccinates, (2) diester sulfosuccinates, (3) sulfosuccinamates, (4) ammonium quaternary salts, (5) phosphonium quaternary salts, (6) sulfonium quaternary salts, (7) thiazolium quaternary salt, (8) benzothiazolium quaternary salts; and mixtures thereof.

22. The method according to claim 10 wherein the thickness of said first coating present on said one surface of said polyester backing substrate is from about 0.1 to about 25 microns.

23. The method according to claim 1 wherein the polyglycol ester compounds of the second coating are selected from (1) poly(ethylene glycol)esters, (2) poly (propyleneglycol)esters, and (3) poly(glyceryl alcohol) esters; and mixtures thereof.

24. The method according to claim 23 wherein said polyethylene glycol esters are selected from: (1) poly (ethyleneglycol) A-laurate where A varies from 1 to 200; (2) poly (ethyleneglycol) B-oleate where B varies from 1 to 400; (3) poly (ethylene glycol)C-stearate where C varies from 1 to 400; (4) poly (ethyleneglycol)D-isostearate where D varies from 1 to 20; (5) poly (ethylene glycol)E-tallate where E varies from 1 to 220; (6) poly (ethylene glycol)F-tallowate where F varies from 1 to 30; (7) poly (ethyleneglycol)G-dilaurate where G varies from 1 to 200; (8) poly(ethyleneglycol)H-dioleate where H varies from 1 to 200; (9) poly(ethyleneglycol)I-distearate where I varies from 1 to 400; (10) poly (ethyleneglycol)J-ditallate where J varies from 1 to 20; (11) poly(ethyleneglycol)K-glyceryl laurate where K varies from 5 to 30; (12) poly (ethyleneglycol)L-glyceryl oleate where L varies from 5 to 30; (13) poly(ethyleneglycol)M-glyceryl stearate where M varies from 5 to 150; (14) poly (ethyleneglycol)N-glyceryl tallowate where N varies from 5 to 200; (15) poly (ethyleneglycol)O-glyceryl ricinoleate where O varies from 5 to 30; (16) poly (ethyleneglycol)P-di-(2-hydroxyethyl)-5,5-dimethyl hydantoin oleate, where P varies from 5 to 30; (17) poly (ethyleneglycol)Q-sorbitan laurate, where Q varies from 2 to 100; (18) poly (ethyleneglycol)R-sorbitan oleate, where R varies from 2 to 50; (19) poly(ethyleneglycol)S-sorbitan stearate, where S varies from 2 to 50; (20) poly (ethyleneglycol), (20) sorbitan, (21) poly(ethyleneglycol) 20-sorbitan-tallate, (22) poly(ethyleneglycol)20-sorbitan-trioleate, (23) poly(ethyleneglycol)20-sorbitan-tristearate, (24) poly (ethylene)20-sorbitan-tritallate; (25) polyethyleneglycol)40-sorbitan diisostearate, (26) poly (ethyleneglycol)40-sorbitan hexoleate, (27) poly (ethyleneglycol)40-sorbitan peroleate, (28) poly ethyleneglycol) 40-sorbitan tetraoleate, (29) poly (ethyleneglycol)60-sorbitan tetraoleate, (30) poly (ethyleneglycol)60-sorbitan tetrastearate; and mixtures thereof.

25. The method according to claim 23 wherein said polypropylene glycol esters are selected from: poly (propyleneglycol)T-oleate where T varies from 2 to 50; poly(propylene glycol)20-methyl glucoside distearate; and mixtures thereof.

26. The method according to claim 23 wherein said polyglyceryl alcohol esters are selected from the group consisting of: (1) poly(glyceryl)2-boratesesquioleate, (2) poly(glyceryl)2-tetrastearate; (3) poly (glyceryl)3-oleate, (4) poly(glyceryl)3-isostearate, (5) poly(glyceryl)3-diisostearate; (6) poly(glyceryl)4-oleate, (7) poly(glyceryl) 6-stearate, (8) poly(glyceryl)6-distearate; (9) (yglyceryl)8-oleate, (10) poly(glyceryl)8-stearate, (11) poly(glyceryl)10-laurate, (12) poly(glyceryl)10-oleate, (13) poly(glyceryl)10-myristate, (14) poly(glyceryl)10-linoleate, (15) poly (glyceryl)10-stearate, (16) poly(glyceryl)10-trioleate, (17) poly (glyceryl)10-tristearate, (18) poly(glyceryl)10-tetracocate, (19) polyglyceryl-10-tetra-oleate, (20) polyglyceryl-10-pentaoleate, (21) poly(glyceryl)10-pentastearate, (22) poly(glyceryl)10-pentaisostearate, (23) poly(glyceryl)10-hexaoleate, (24) poly (glyceryl)10-hepta-oleate, (25) poly(glyceryl)10-heptastearate, (26) poly (glyceryl)10-heptaisostearate, (27) poly(glyceryl)10-octaoleate, (28) poly(glyceryl)10-decaoleate, (29) poly (glyceryl)10-decastearate, (30) poly(glyceryl)10-decaisostearate; and their mixtures.

27. The method according to claim 23 wherein the thickness of said at least a second coating layer in contact with the first coating layer present on one front surface of the backing substrate is from about 0.1 to about 25 microns.

28. The method according to claim 1 wherein said third coating present is comprised of from about 89 percent by weight to about 20 percent by weight of the binder or mixture thereof, from about 0.5 percent by weight to about 20 percent by weight of the antistatic agent or mixture thereof, from about 0.5 percent by weight to about 20 percent by weight of the lightfastness inducing agent or mixture thereof, and from about 10 percent by weight to about 40 percent by weight of the filler or mixture thereof.

29. The method according to claim 28 wherein said binder comprising said third coating is selected from the group consisting of polyester resins are selected from the group comprised of (1) polyglycolide, (2) polyglactin, (3) titanium derivatives of polyesters, (4) polyester latex, (5) polyethylene terephthalate resins, (6) polyarylates resins, (7) polybutylene terephthalate based ester resins, (8) unsaturated polyester resins, (9) rosin modified maleic polyester resins, (10) polyester flame retardant, (11) polyester adipate, (12) polyester azelate, (13) polyester glutarate, (14) polyester nylonate, (15) polyester phthalate, (16) thiodipropionate polyester, (17) polyester-co-polycarbonate resins, (18) cellulose acetate hydrogen phthalate, (19) hydroxypropylmethyl cellulose phthalate, (20) hydroxypropyl methyl cellulose succinate, (21) cellulose acetate butyrate, (22) cellulose propionate, (23) poly (vinyl acetate), (24) poly(vinylformal), (25) poly (vinyl butyral), (26) vinylalcohol-vinylbutyralcopolymers, (27) vinylalcohol-vinylacetate-copolymers, (28) vinylchloride-vinylacetatecopolymers, (29) vinylchloride-vinylacetate-vinylalcohol-terpoly, (30) vinylchloride-vinylidenechloride-copolymers, (31) cyano ethylated cellulose, (32) cellulose acetate hydrogen phthalate, (33) hydroxypropylmethyl cellulose phthalate, (34) hydroxypropyl methyl cellulose succinate, (35) cellulose triacetate, (36) cellulose acetate butyrate, (37) (acrylamidomethyl) cellulose acetate butyrate, (38) cellulose propionate, (39) polystyrene, (40) poly(4-methylstyrene), (41) poly(α-methylstyrene), (42) poly(tert-butylstyrene), (43) poly(chlorostyrene), (44) poly (bromostyrene), (45) poly(methoxy styrene) (46) poly(2,4,6-tribromostyrene), (47) styrene-butylmethacrylate copolymers, (48) styrene-acrylonitrile copolymers, (49) styrene-allyl alcohol copolymers, (50) poly(vinylpyridine), (51) poly(vinylpyridine-co-styrene), (52) poly(4-vinylpyridine-co-butylmethacrylate), (53) poly (vinyltoluene), (54) poly(2-vinylnaphthalene), (55) poly (methylmethacrylate), (56) poly(ethylmethacrylate), (57) poly(phenylmethacrylate), (58) polyamide resin, (59) poly (p-phenylene-ether-sulfone), (60) polycarbonate, (61) α-methyl styrenedimethylsiloxane block copolymers, (62) dimethyl siloxane-bisphenol A carbonate block copolymers, (63) poly(2,6-dimethyl p-phenylene oxide); and mixtures thereof.

30. The method according to claim 28 wherein said third coating contains pigmented particles which are selected from (1) zirconium oxide, (2) colloidal silicas, (3) titanium dioxide, (4) hydrated alumina, (5) barium sulfate, (6) calcium carbonate, (7) high brightness clays, (8) calcium silicate, (9) cellulosic materials, (10) blend of calcium fluoride and silica, (11) zinc oxide, (12) blends of zinc sulfide with barium sulfate.

31. The method according to claim 28 wherein said third coating includes an antistatic agent selected form the group consisting of (1) monoester sulfosuccinates, (2) diester sulfosuccinates, (3) sulfosuccinamates, (4) ammonium quaternary salts, (5) phosphonium quaternary salts, (6) sulfonium quaternary salts, (7) thiazolium quaternary salt, (8) benzothiazolium quaternary salts; and mixtures thereof.

32. The method according to claim 28 wherein the thickness of said third coating is from about 0.1 to about 25 microns.

33. The method according to claim 1 wherein said step of providing a wrong reading polyester toner image is effected using toner material comprised of a crosslinked, lowmelt polyester resin.

34. The method according to claim 1 including the step of providing a hydrophobic scuff/abrasion resistant polymeric binder on another surface of said transparent polyester substrate.

* * * * *